US011518579B2

(12) United States Patent
Azelton et al.

(10) Patent No.: US 11,518,579 B2
(45) Date of Patent: Dec. 6, 2022

(54) DISPENSING CLOSURE WITH PLUG SEALING AND LOCKING LUG

(71) Applicant: THE CLOROX COMPANY, Oakland, CA (US)

(72) Inventors: Kerry D. Azelton, Pleasanton, CA (US); Benjamin Ma, Pleasanton, CA (US); Joshua R. Bush, Asheboro, NC (US); Adam Frederick, Asheboro, NC (US); Jon Markey, Asheboro, NC (US); Alexandria Rinella, Pleasanton, CA (US)

(73) Assignee: THE CLOROX COMPANY, Oakland, CA (US)

( * ) Notice: Subject to any disclaimer, the term of this patent is extended or adjusted under 35 U.S.C. 154(b) by 1 day.

(21) Appl. No.: 16/941,156

(22) Filed: Jul. 28, 2020

(65) Prior Publication Data

US 2021/0031983 A1 Feb. 4, 2021

Related U.S. Application Data

(60) Provisional application No. 62/880,283, filed on Jul. 30, 2019.

(51) Int. Cl.

| | |
|---|---|
| ***B65D 1/02*** | (2006.01) |
| ***B65D 25/48*** | (2006.01) |
| ***B65D 41/04*** | (2006.01) |
| ***B65D 41/26*** | (2006.01) |
| ***B65D 47/06*** | (2006.01) |
| ***B65D 47/40*** | (2006.01) |

(Continued)

(52) U.S. Cl.

CPC ..... *B65D 25/48* (2013.01); *B65D 1/0246* (2013.01); *B65D 41/0428* (2013.01); *B65D 41/26* (2013.01); *B65D 47/06* (2013.01); *B65D 47/40* (2013.01); *B65D 50/048* (2013.01); *B65D 2203/04* (2013.01); *B65D 2251/0015* (2013.01); *B65D 2251/0025* (2013.01)

(58) Field of Classification Search

CPC .. B65D 25/48; B65D 1/0246; B65D 41/0428; B65D 41/26; B65D 47/06; B65D 47/40; B65D 2251/0015; B65D 2251/0025; B65D 2203/04; B65D 50/048

See application file for complete search history.

(56) References Cited

U.S. PATENT DOCUMENTS 2,061,685 A * 11/1936 Wheaton ..... G01F 19/00 141/381
3,917,097 A * 11/1975 Uhlig ..... B65D 50/046 215/216

(Continued)

OTHER PUBLICATIONS

Examiner's Report for Canadian Patent Application No. 3,088,750 dated Jan. 4, 2022, 5 pages.

*Primary Examiner* — Frederick C Nicolas
(74) *Attorney, Agent, or Firm* — Edell, Shapiro & Finnan, LLC

(57) ABSTRACT

A closure for a bottle includes an upper portion, a lower portion attached to the upper portion and including a flange extending inwardly from an interior wall of the lower portion, and the flange resides entirely within the lower portion. The closure further includes one or more grip elements located on an outer surface of the lower portion, and an annular sleeve disposed in the lower portion and including a set of interior threads.

16 Claims, 21 Drawing Sheets

(51) Int. Cl.
*B65D 50/00* (2006.01)
*B65D 50/04* (2006.01)

(56) References Cited

U.S. PATENT DOCUMENTS 4,464,316 A * 8/1984 Michaels ..... B65D 41/0471 261/121.1
4,566,509 A * 1/1986 Szajna ..... B65D 41/26 215/276
4,844,302 A * 7/1989 Lay ..... B65D 47/127 141/381
4,875,600 A * 10/1989 D'Hoogue ..... B65D 41/26 222/454
5,213,223 A * 5/1993 Minnette ..... B65D 25/42 215/216
5,251,788 A * 10/1993 Moore ..... B65D 47/123 222/111
5,435,467 A * 7/1995 Ekkert ..... B65D 47/122 222/143
5,687,863 A * 11/1997 Kusz ..... B65D 41/0471 215/216
5,794,803 A * 8/1998 Sprick ..... B65D 41/265 215/217
5,921,417 A * 7/1999 Mull ..... B65D 50/046 215/334
6,112,921 A * 9/2000 Robinson ..... B65D 50/046 215/216
7,097,076 B1 * 8/2006 Giblin ..... B65D 47/40 222/569
7,621,413 B2 * 11/2009 Miota ..... B65D 47/0804 220/300
7,775,393 B1 * 8/2010 Feldman ..... B65D 51/246 215/229
7,971,455 B2 * 7/2011 De Wree ..... D06F 39/024 68/213
8,302,792 B2 * 11/2012 Logel ..... B65D 41/3409 215/216
8,870,004 B2 * 10/2014 McCoy ..... B65D 50/04 40/310
9,371,165 B2 * 6/2016 Brannon ..... B65D 50/046
10,207,840 B2 * 2/2019 Sprick ..... B65D 1/023
10,689,158 B2 * 6/2020 Sprick ..... B65D 47/40
11,401,085 B2 * 8/2022 French ..... B65D 1/0246
2006/0032872 A1 * 2/2006 Yamane ..... B65D 83/06 222/566
2007/0194047 A1 * 8/2007 Tauber ..... B65D 47/122 222/109
2009/0014465 A1 * 1/2009 De Wree ..... D06F 39/024 510/438
2013/0097973 A1 4/2013 McCoy et al.
2015/0048113 A1 * 2/2015 Brannon ..... B65D 50/046 222/109
2015/0314930 A1 * 11/2015 Stripp ..... B65D 47/20 222/566
2017/0320631 A1 11/2017 Sprick et al.
2021/0031983 A1 * 2/2021 Azelton ..... B65D 1/0246

* cited by examiner

DISPENSING CLOSURE WITH PLUG SEALING AND LOCKING LUG

CROSS-REFERENCE

This application claims the benefit of and priority to U.S. Provisional Application No. 62/880,283, filed Jul. 30, 2019. The disclosure is herein incorporated by reference in its entirety.

FIELD OF THE INVENTION

Embodiments of the present invention generally concern bottles that may be used to hold a variety of materials. More particularly, some example embodiments of the invention relate to a dispensing closure with plug sealing and locking lugs, and associated bottle. Other example embodiments concern a child resistant closure.

BACKGROUND

A variety of bottles exist that hold materials, such as liquid or powder laundry detergent for example, that would be harmful if ingested. This is of particular concern with respect to children, as they may not appreciate the danger presented by ingestion.

While various child resistant closures are known to exist, they are typically relatively small in size. Some examples of such child resistant closures include those found on a cough syrup bottle, or aspirin bottle. Because these child resistant closures are relatively small and could be grasped by the smaller hand of a child, it is possible that, in some instances, a child could accidentally defeat the child resistant feature of such a closure and thereby gain access to the contents of the bottle.

A related consideration regarding known child resistant closures is that their small size and/or their configuration typically renders them ineffective for dosing. Consequently, it is often the case that a separate dosing cup must be provided. This additional cup increases the cost of the product, as well as the associated waste.

Where a dosing cup is provided, it commonly occurs that the consumer overfills the dosing cup. As a result, product is spilled and wasted.

In light of considerations such as those noted above, it would be useful to provide one or more closures, and/or an associated bottle, that are effective in resolving one or more of the problems identified.

ASPECTS OF AN EXAMPLE EMBODIMENT

Embodiments within the scope of the invention may be effective in overcoming one or more of the problems in the art, although it is not required that any embodiment resolve any particular problem(s). In general, embodiments of the present invention concern bottles that include a removable closure and may be used to hold a variety of different types and forms of materials, examples of which include, but are not limited to, liquids such as liquid laundry detergents.

Some embodiments of the bottle may include one or more lugs that interfere with corresponding flanges of a closure in such a way that the closure cannot be rotated and removed from the bottle unless the flanges are deflected to a sufficient extent. In some embodiments, the portion of the closure that includes the flanges may be sufficiently stiff and large in diameter that the relatively small hand of a child would not be big enough to grip, nor strong enough to effectively squeeze, the closure. Depending upon the embodiment, ribs and/or other structural features to increase stiffness or pliability of the closure may be added to provide desired functionality. Embodiments in which the flange(s) of a closure interact with the lugs of a bottle neck finish may be referred to herein constituting, or comprising, an anti-rotation feature and/or a child resistant feature. In some embodiments, the lug/flange system may act to halt the closure from unscrewing from the bottle, such as during transportation of the bottle to which the closure is connected. In some embodiments, the lug/flange system may prevent opening of the bottle or container unless or until the flange(s) are deflected a sufficient distance from the lugs that the closure can be rotated off the container. Such embodiments may be referred to as implementing a 'child resistant' feature.

In general then, the present disclosure embraces, among other things, two different closure/bottle configurations. The bottle geometry may, or may not, be the same for both closure/bottle configurations.

A first one of the closure/bottle configurations may comprise lugs on the bottle that interact with flanges of the closure. This general flange/lug configuration may be implemented in various ways. For example, when the flanges are located approximately opposite the grip elements of the closure (see, e.g., FIG. 5) or within about 35 degrees to about 55 degrees away from the grip elements of the closure, such that the closure must be squeezed at/near the grip elements in order to eliminate material interference between the flanges and lugs, such a configuration may be referred to as a child-resistant (CR) configuration since the closure cannot be removed from the bottle by a child due to the interference between the flanges/lugs, and due to the manipulation of the closure that is required to overcome that interference and remove the closure from the bottle. Thus, this configuration may implement both an anti-backoff feature, and a child resistant feature that may be enabled by relatively close proximity of the flanges to grip elements on the closure.

A second one of the closure/bottle configurations may omit the lugs from the bottle, while retaining the flanges in the closure. This configuration may, or may not, be child resistant, but the presence of the flanges and their contact with the bottle structure may nonetheless provide an anti-rotation, or anti-backoff, feature, that may prevent the closure from inadvertently coming off the bottle, such as when the bottle is being transported, for example.

In more detail, in one example embodiment, a child resistant closure may have a maximum outside diameter of about 60 mm, although the scope of the invention is not limited to any particular outside diameter for the closure. The closure is threaded internally and uses a squeeze and turn motion to be engaged with, and disengaged from, corresponding external threads of the bottle.

The child resistant feature comprises one or more lugs on the bottle side that are in a selective interference relationship with a respective corresponding flange on the closure side. When the closure is squeezed at the correct point, and with adequate force, the flanges in the closure are deflected away from the lugs, thereby eliminating the interference, and the closure can then be unthreaded from the bottle. In some embodiments, the closure can be removed from the bottle even if the flanges are still in contact with the lugs, so long as that contact is not substantial, that is, so long as the interference between the lugs and flanges is insubstantial. Thus, the lug, or lugs, would only fail to interfere with the flanges when the closure is squeezed and the flanges deflected away from the lugs.

In some embodiments, the closure is also configured to serve as a dosing cup, although this is not required. For example, the dosing cup includes a central cavity into which liquid from the bottle may be poured. There is a space defined by the intersection of the central cavity wall and outer wall that creates an overflow reservoir. In the event the consumer overfills the cup, liquid can be captured in this volume and then returned to the bottle without contacting the threads inside the cap and causing liquid to drip on the exterior surface of the bottle. In some embodiments, the overflow reservoir may be omitted.

To attach the closure to the bottle, the user can grasp the closure and simply rotate the closure until it is fully seated on the bottle. Threads inside the closure mate with threads on the exterior of the bottle to aid in attachment and removal of the closure, and to help retain the closure on the bottle. As the closure is rotated clockwise to the closed position, a flange of the closure passes over a ramp portion of a lug on the bottle and moves into a position, which may be referred to herein as an interference position, opposite an upstanding wall near the end of the ramp. This movement of the flange may involve some elastic deformation of the flange. When the flange is thus positioned, the upstanding wall prevents counterclockwise motion of the flange, and the closure is thus locked to the bottle.

To remove the closure, the user can grasp and squeeze the closure, thereby elastically deflecting the flange to a position and orientation where the upstanding wall of the lug no longer materially impairs a change in position of the flange. This position may be referred to herein as a non-interference position but, as noted, even in the non-interference position, there may be some insubstantial contact between the flange and the lug. When the flange is in the non-interference position, the closure can then be rotated relative to, and removed from, the bottle. In at least some embodiments, there is no need to continue to squeeze the closure once the deflected flange has been moved past the nearest lug.

Advantageously then, example embodiments of the invention are directed to a bottle and closure that may serve to prevent a child from accessing the contents of the bottle. Embodiments of the invention may, or may not, include an overflow reservoir. Some embodiments may be configured such that the cap is prevented from inadvertently backing off of the bottle and becoming partly, or completely, disengaged from the bottle. This configuration and functionality may be useful, for example, when the bottle is being transported, since there may be some assurance that no leakage will occur even while the bottle is being moved and reoriented. Example embodiments of the invention include a closure that may be provided with an overflow reservoir configured and arranged to prevent liquid contents from flowing onto the threads of the closure and, thus, to the exterior of the bottle when the closure is placed on the bottle. Embodiments of the closure may include a relatively large central cavity so as to enable use of the closure as a dosing cup.

Some example embodiments of the invention may be used in connection with detergent, which may be in a loose granular form, or in a liquid form. Any other powders, liquids, or granular materials, in whatever form, may also be used. Yet other embodiments of the invention may be employed with liquids, dry materials, pastes and gels, for example.

BRIEF DESCRIPTION OF THE DRAWINGS

In order to describe the manner in which at least some aspects of this disclosure can be obtained, a more particular description will be rendered by reference to specific embodiments thereof which are illustrated in the appended drawings. Understanding that these drawings depict only example embodiments of the invention and are not therefore to be considered to be limiting of its scope, embodiments of the invention will be described and explained with additional specificity and detail through the use of the accompanying drawings.

DETAILED DESCRIPTION OF SOME EXAMPLE EMBODIMENTS

Reference will now be made in detail to aspects of various embodiments of the present disclosure, examples of which are illustrated in the accompanying drawings. While described in conjunction with these embodiments, it will be understood that they are not intended to limit the disclosure to these embodiments.

In general, embodiments of the invention may be employed in storing liquid and dry materials of various forms such as powders, liquids, and granular materials, for example. Some particular example embodiments of the invention may be used for the storage of laundry detergent in powder or liquid form, although the scope of the invention is not limited to any particular application or stored material. Thus, further examples of such dry materials include, but are not limited to, de-icing salts, lawn and garden chemicals such as fertilizers, and any other dry materials that may be contained by one of the disclosed embodiments. Still other particular examples of materials with which various disclosed embodiments may be employed include, but are not limited to, food, gels and paste, beverages, supplements of various types including vitamins and dietary supplements, toys (e.g., army men, LEGO® blocks and pieces, blocks, cars, beads), laundry detergent, laundry bleach, cleaning formulas, cleaning gels, dry chemicals, cleaning utensils, personal care items, shampoo & conditioner, outdoor chemicals (e.g., pool chemicals), paint, litter for pet litter boxes, pet supplements and food, pet treats, pet toys, powder mix for food and drinks, beverage powder, candy and chocolates, nuts, toy articles, medical and/or hospital kits, charcoal. Additional examples of liquids with which some embodiments of the invention may be used include, but are not limited to, cleaning agents, cleaning solutions, cleaning compositions, lawn and garden chemicals, antifreeze, window washing chemicals, windshield de-icing liquids, motor oil, and any other liquids that may be contained by one of the disclosed embodiments. Further examples of materials that may be employed in connection with one or more of the disclosed embodiments include vitamins and medicines, whether in liquid or dry form.

More generally, and as the aforementioned examples collectively demonstrate, embodiments of the invention are not limited to use with any particular material(s). Moreover, embodiments of the invention embrace both bottles that are empty, as well as bottles that are full, or partly full, of any of the materials disclosed herein, and/or any other materials.

A. Example Bottle

Figure 1:
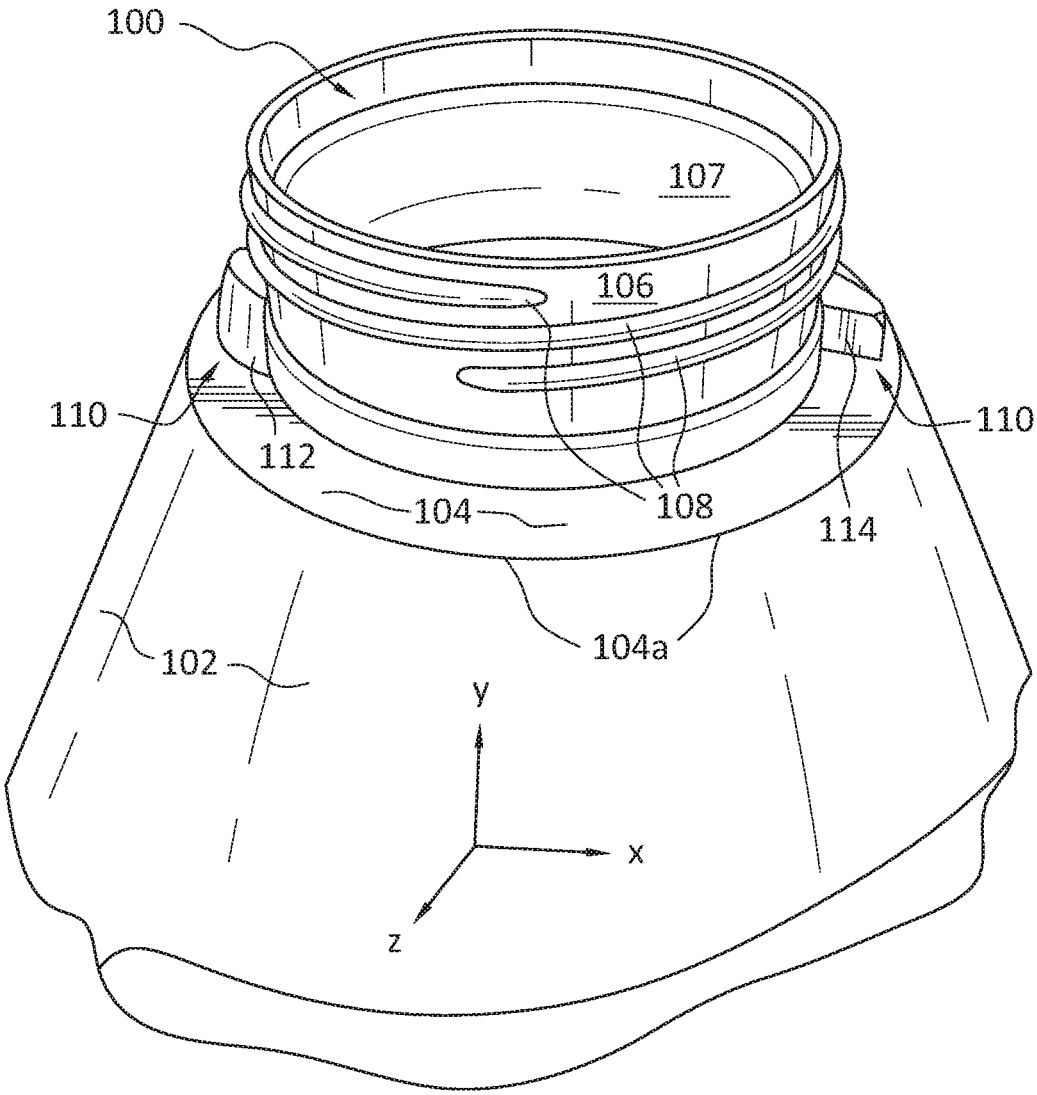
FIGS. 1-3, and 3*a*, are perspective views of a bottle according to various example embodiments of the invention.
Figure 2:
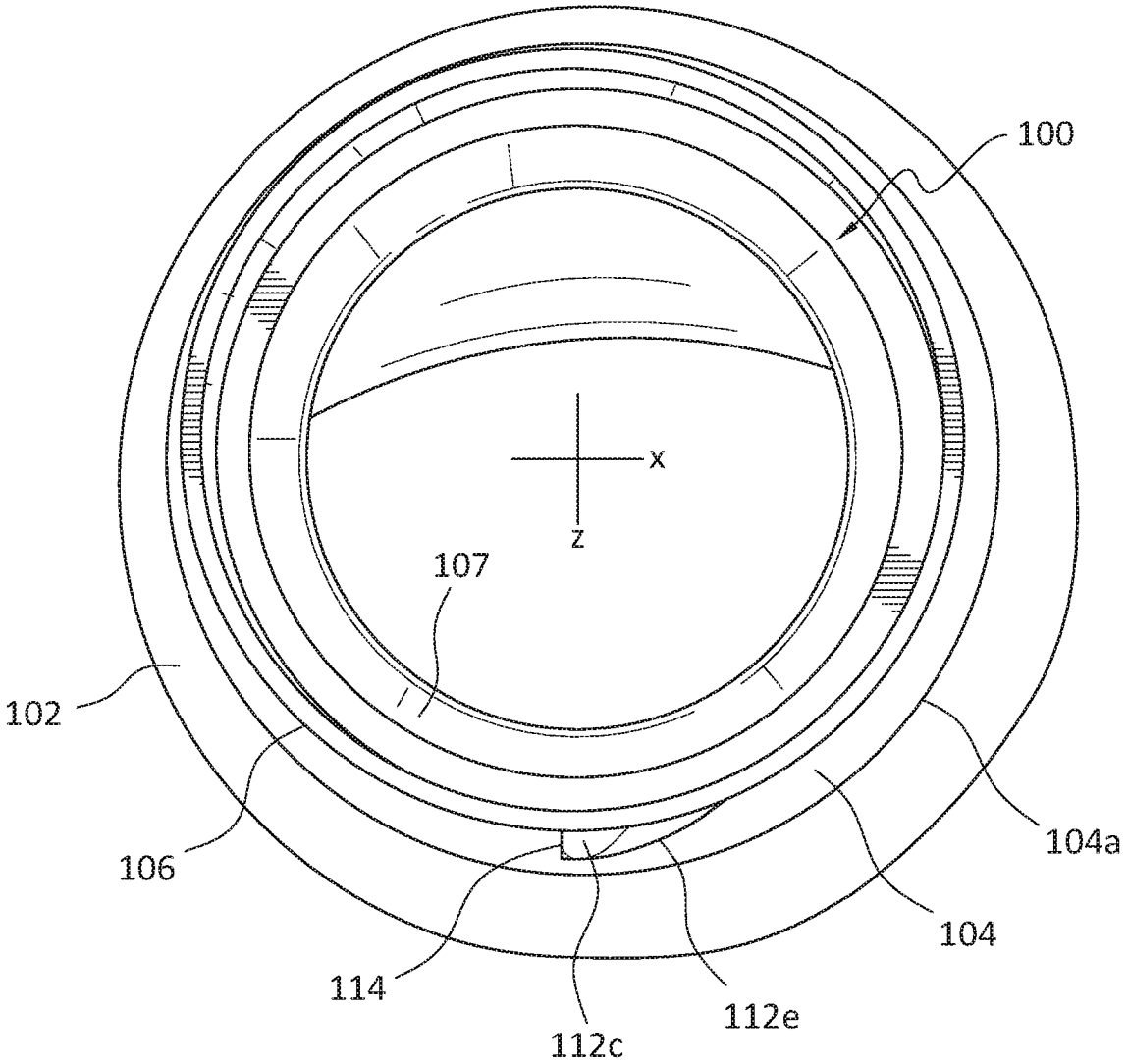
Figure 3:
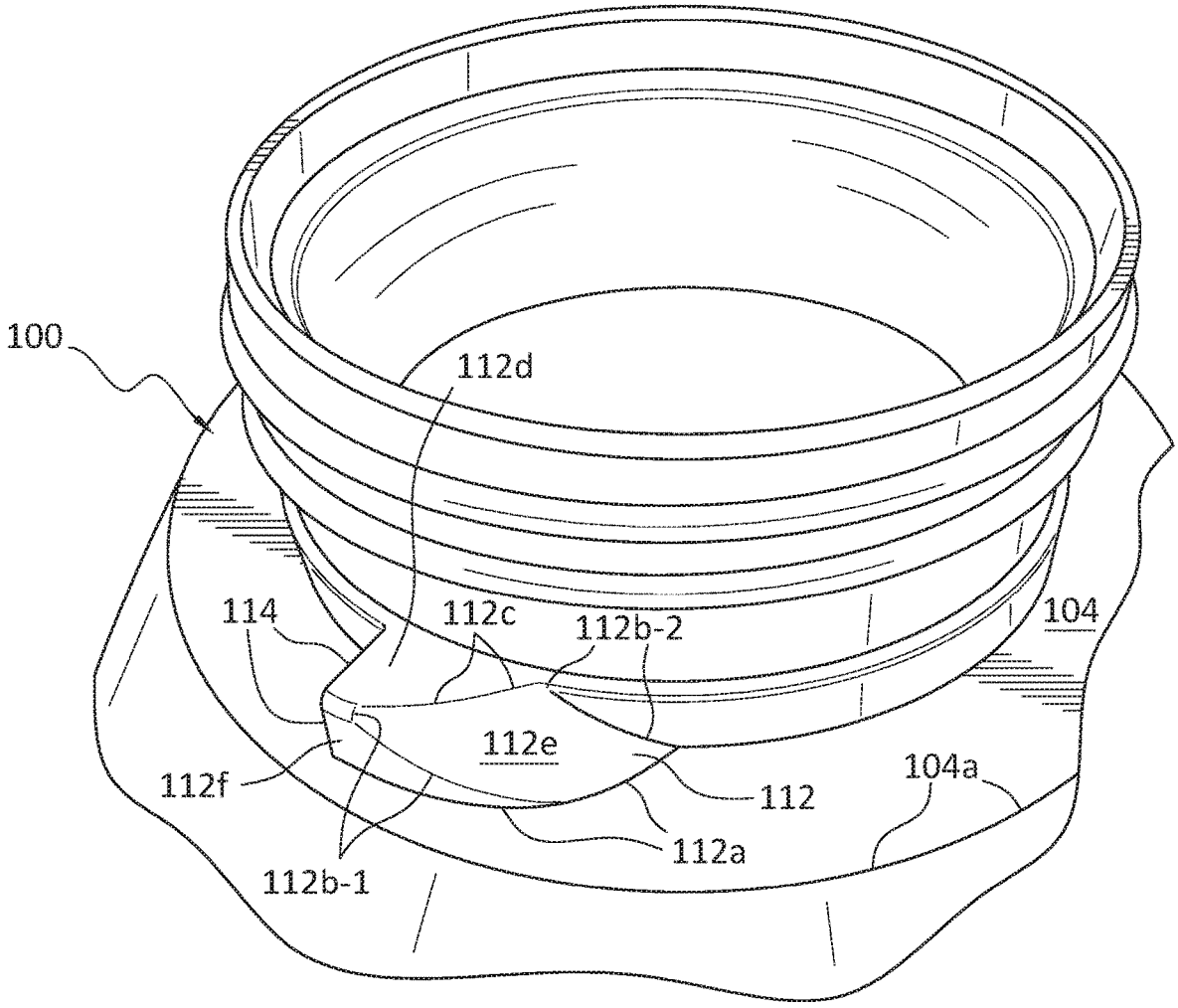
Figure 3A:
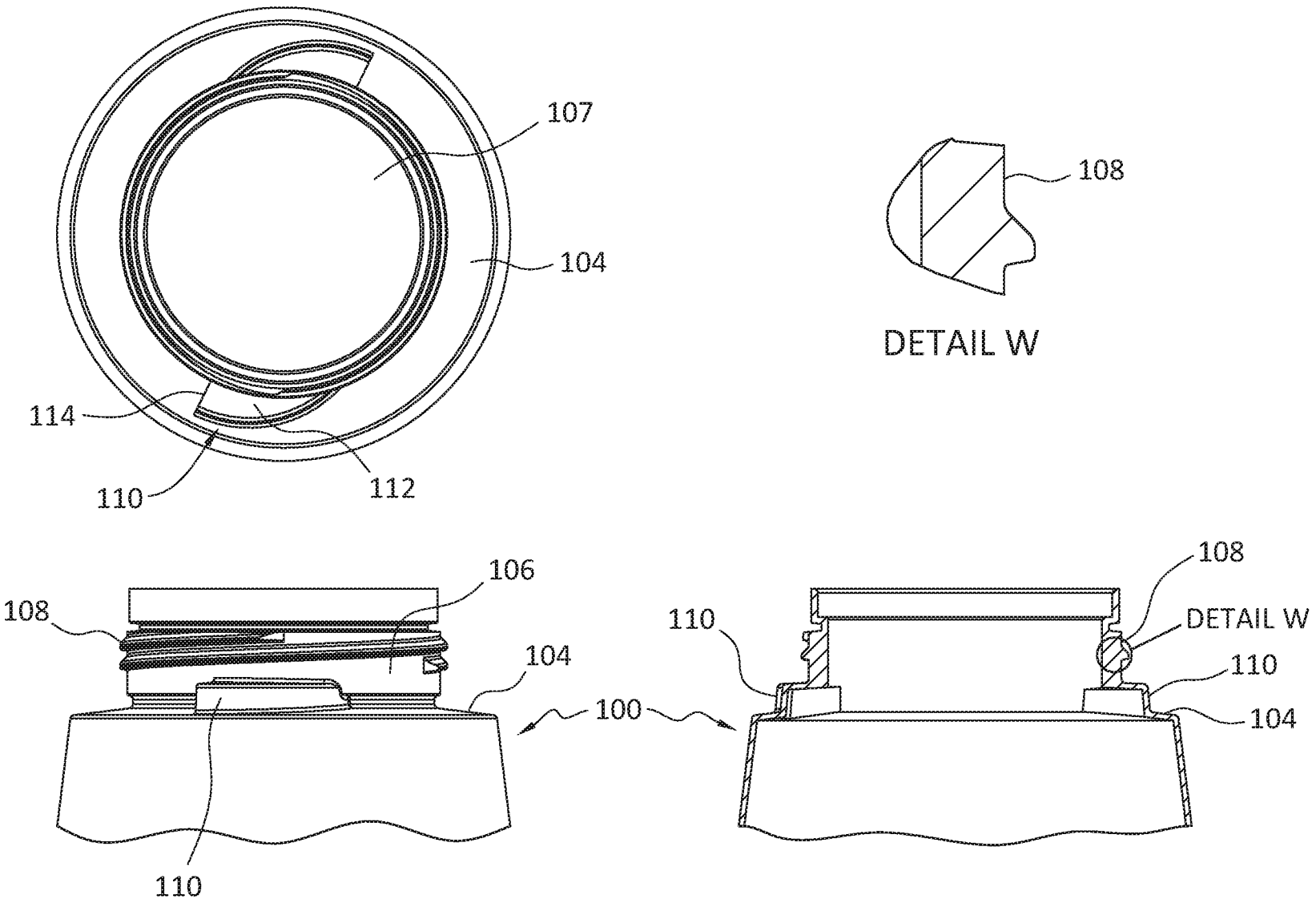
Figure 4:
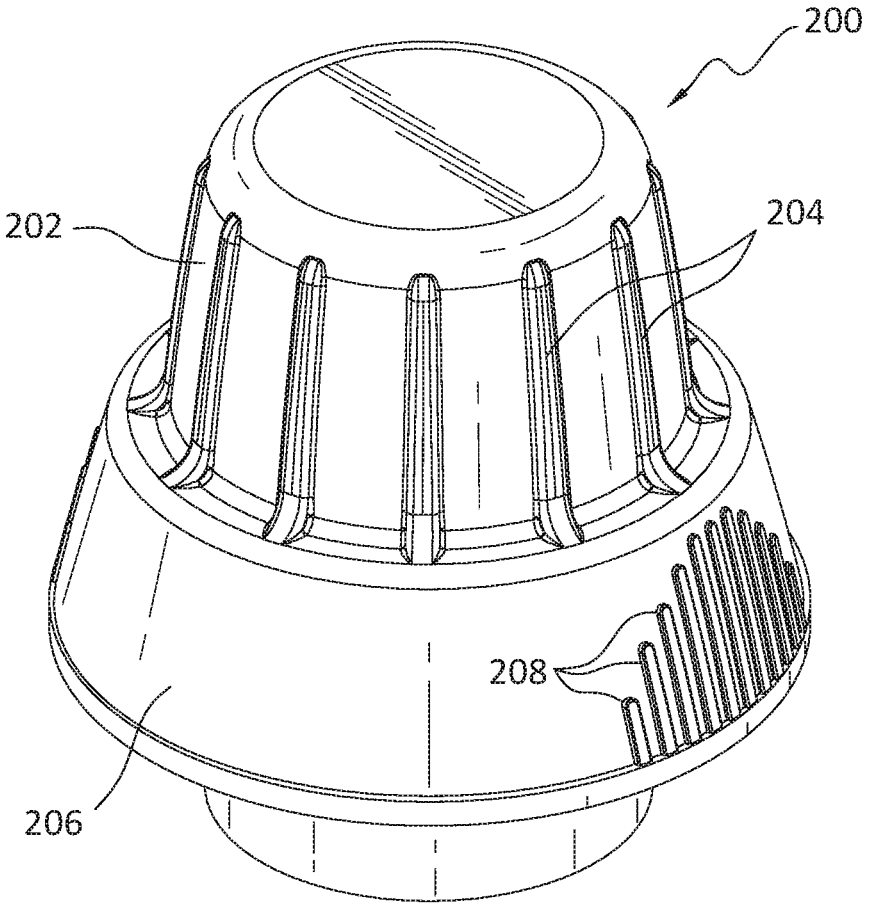
FIG. 4 is a side perspective view of an example closure.

Directing attention first to FIGS. 1-3*a*, details are provided concerning an example bottle. As shown in FIG. 1, reference axes x, y, and z indicate a respective x-direction, y-direction, and z-direction. To illustrate, the y-direction corresponds to a vertical axis that is perpendicular to a horizontal x-z plane defined by the opening of the bottle. FIG. 3*a* discloses some example dimensions for the neck portion of an example embodiment of a bottle.

The illustrative example of the bottle is denoted generally at 100. In at least some embodiments, the bottle 100 comprises, or consists of, plastic, although other materials could alternatively be used. The bottle 100 can be formed using any suitable method or process, examples of which include injection molding, blow-molding, and vacuum molding. When manufacturing processes such as these are employed, the bottle 100 can be formed of a single piece of material, although that is not necessarily required. The bottle 100 may be any shape or size and may be colored or clear, and translucent or opaque.

In general, the example bottle 100 includes an outer wall 102 that cooperates with a bottom (not shown) of the bottle 100 to define part of a volume that may hold any of the materials disclosed herein, including a liquid laundry detergent. The outer wall 102 is connected by an annular shoulder 104 to a neck 106, both of which may be substantially circular in shape. In at least some embodiments, the body of the bottle 100 has a relatively larger outer perimeter than a perimeter of the neck 106. The neck 106 defines a mouth 107 and may include threads 108 external to the neck 106 and configured to releasably engage corresponding threads of a mating closure, as discussed below. Any size, pitch, angle, type or arrangement of threads 108 can be used. In some particular embodiments, the threads 108 include a relatively small number of thread starts, for example, three or fewer thread starts. No particular thread size or configuration is required by any embodiment.

The example bottle 100 further includes one or more lugs 110 disposed on the annular shoulder 104. The lugs 110 may be integral with the bottle 100, although that is not necessarily required. Where multiple integral lugs 110 are provided, they may be spaced equidistantly about the circumference of the annular shoulder 104, although that is not required and, in some embodiments, the integral lugs 110 are not spaced equidistantly. The integral lugs 110 may extend outwardly to, or near, an outer edge 104*a* of the annular shoulder 104. The number, size, spacing, and orientation, of the integral lug(s) 110 may be implemented in any of a variety of ways and, as such, the configuration shown in the Figures is provided only for the purpose of illustration.

In some example embodiments, two lugs 110 may be provided that are about 180 degrees apart from each other. However, more, or fewer, lugs 110 may be employed in other embodiments. As well, the spacing between successive lugs 110 may be greater, or less than, about 180 degrees. For example, one embodiment may include three lugs 110 that are spaced about 120 degrees apart from each other. Thus, the scope of the invention is not limited to the example lug 110 configuration and arrangement disclosed in the Figures.

Each of the integral lugs 110 includes a ramp portion 112 that terminates at an upstanding wall 114, that may be radially oriented with respect to a central vertical axis 'y' defined by the neck 106. The ramp portion 112 is configured and arranged so that a vertical y-direction height of the ramp portion 112 increases in a clockwise direction (when the bottle 100 is viewed from the top, as shown in FIG. 2). As further indicated in FIGS. 1-3*a*, the ramp portion 112 may include a curved bottom edge 112*a*, a curved outside edge 112*b*-1, a curved inside edge 112*b*-2, and an upper edge 112*c* that defines an intersection between an upper surface 112*d* and a face 112*e* of the ramp portion 112. Finally, an outside upstanding wall 112*f* extends between the bottom edge 112*a* and the side edge 112*b*.

B. Example Closure

With reference now to FIGS. 4-14, details are provided concerning a closure that can be used in conjunction with a bottle such as bottle 100. One example of a closure is denoted in the Figures generally at 200. In at least some embodiments, the closure 200 comprises, or consists of, plastic, although other materials could alternatively be used. The closure 200 can be formed using any suitable method or process, examples of which include injection molding, blow-molding, and vacuum molding. When manufacturing processes such as these are employed, the closure 200 can be formed of a single piece of material, although that is not necessarily required. The closure 200 can be any shape or size and may be colored or clear, and translucent or opaque.

As indicated, the closure 200 is generally circular in shape, although other shapes and configurations, such as any polygon for example, could alternatively be used. The closure 200 may be considered in terms of the size of its outside diameter. As such, example embodiments of the closure 200 may have a maximum outside diameter in a range of about 50 mm to about 70 mm, although smaller or larger closure 200 outside diameters could be used in other embodiments.

The closure 200 includes an upper portion 202, which may have a generally conical configuration, that includes one or more upper grip elements 204. Any number, size, shape, configuration, and orientation, of upper grip elements 204 may be used and the upper grip elements 204 may, or may not, be spaced equidistantly about the circumference of the upper portion 202. In the illustrated example, the upper grip elements 204 take the form of ribs that are spaced generally equidistantly about the circumference of the upper portion 202.

In one embodiment, the outside diameter at, or near, the top of the upper portion 202 may be about 45.47 mm without taking into account the upper grip elements 204. When the upper grip elements are taken into consideration, the outside diameter at, or near, the top of the upper portion 202 may be about 47.29 mm. These dimensions are provided only by way of example, and are not intended to limit the scope of the invention. Larger, and smaller, outside diameters of the top of the upper portion 202 may be employed in other embodiments.

Figure 8:
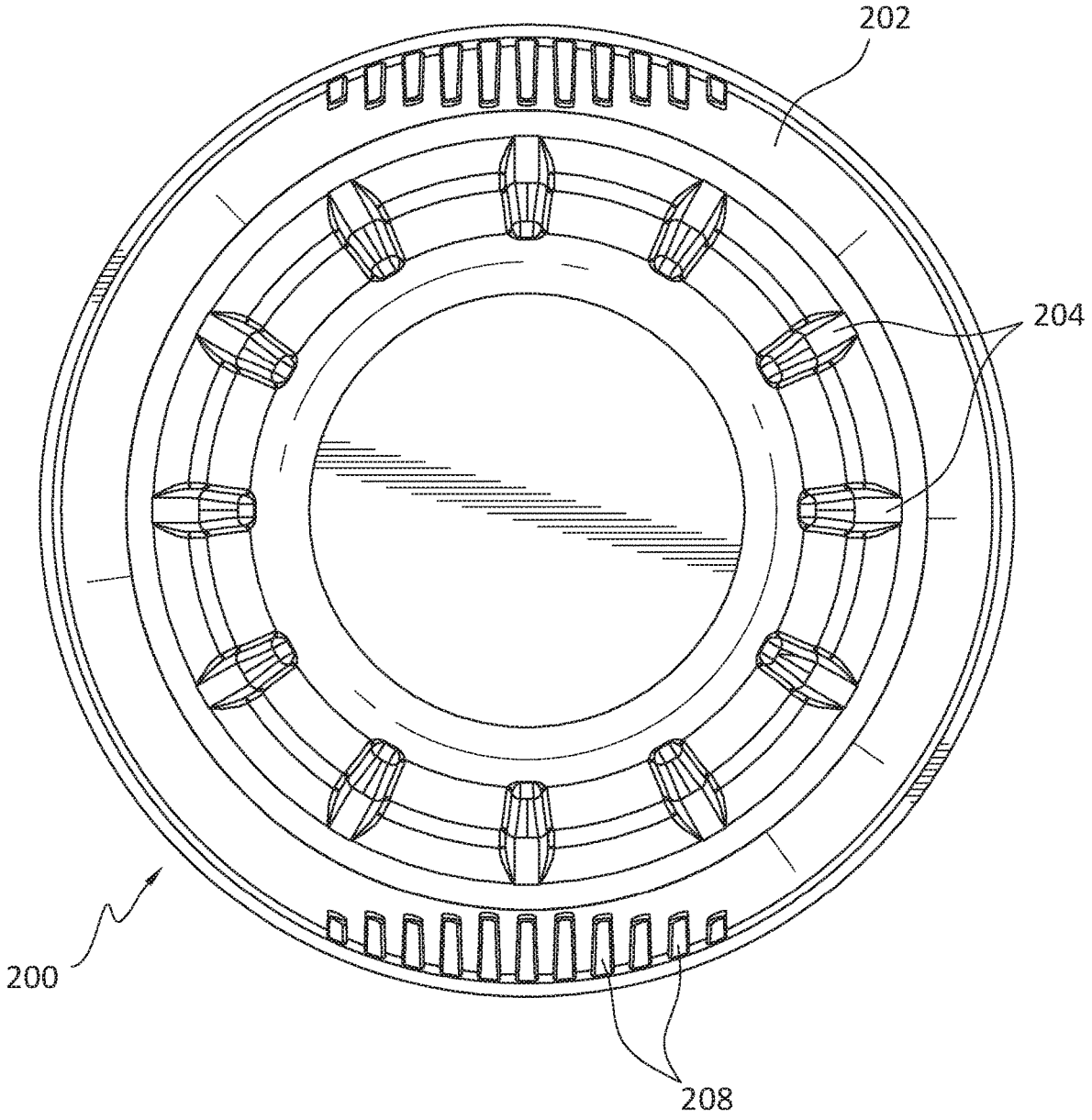
FIG. 8 is a top view of an example closure.
Figure 9:
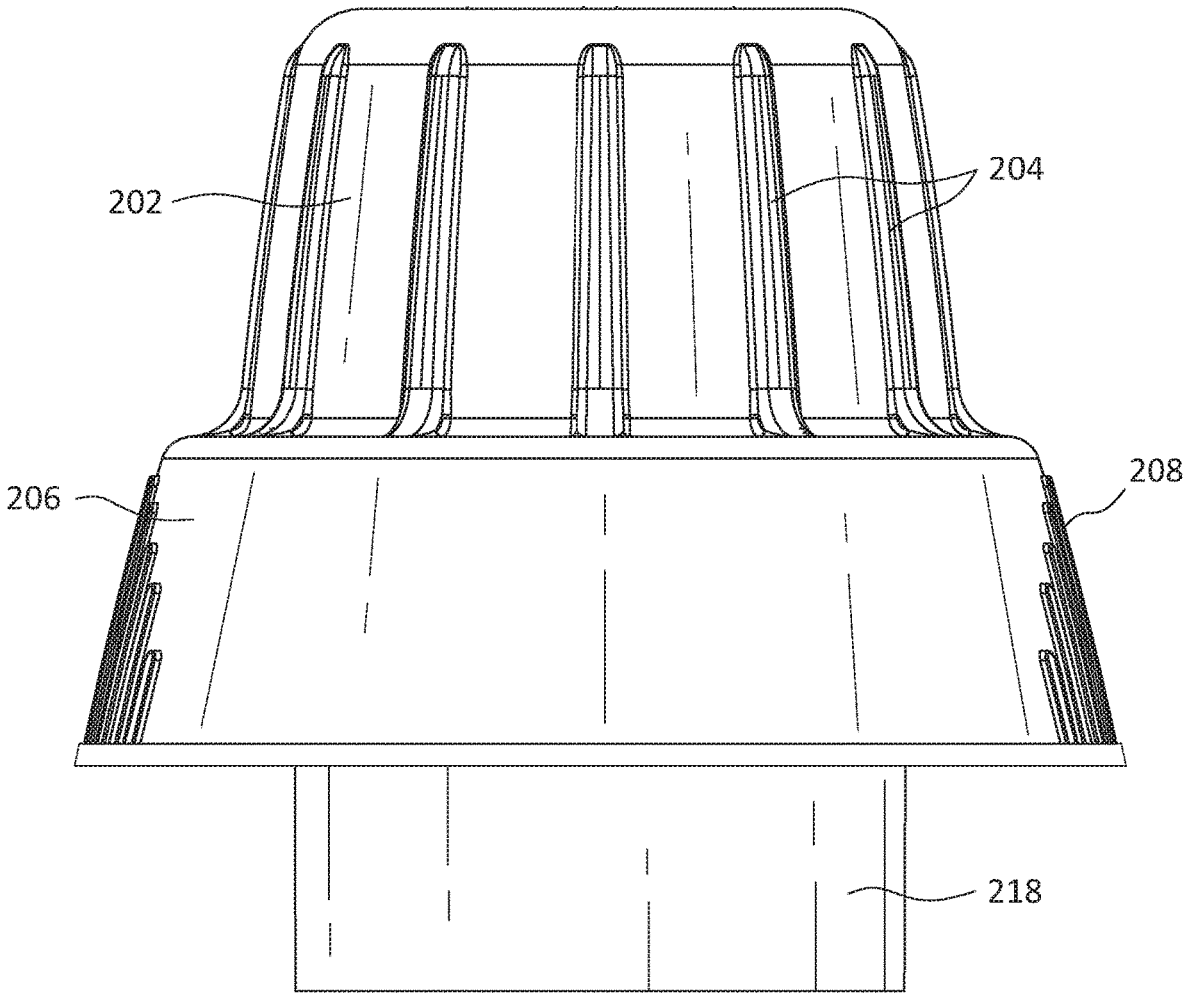
FIG. 9 is a side view of an example closure.

As indicated in the Figures, the example closure 200 further includes a lower portion 206 that may be flared outwardly and is connected to the upper portion 202. The lower portion 206 may include one or more grip elements 208. As best shown in FIG. 8, there may be two, or more, sets of grip elements 208 that may, or may not, be spaced about equidistantly about the circumference of the lower portion 206. In one example embodiment, two sets of grip elements 208 are provided that are located about 180 degrees apart from each other.

Figure 5:
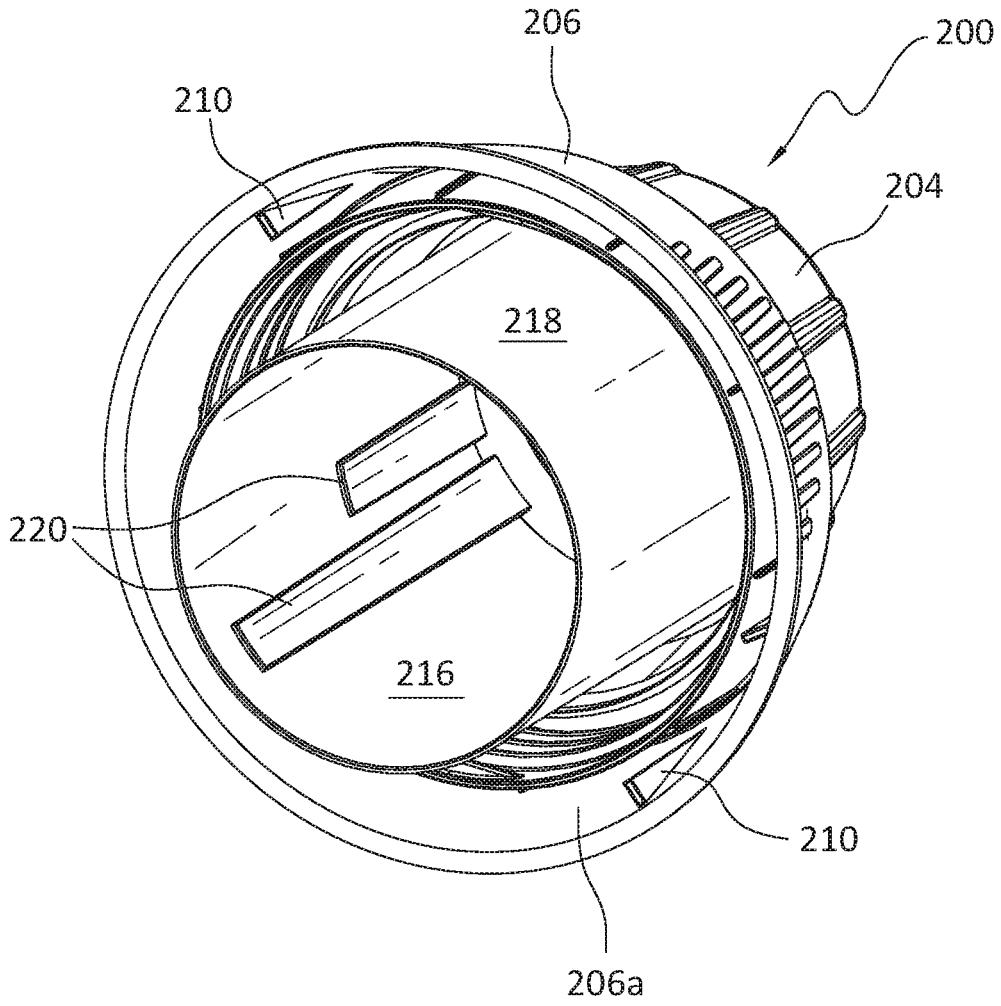
FIG. 5 is a bottom perspective view of an example closure.
Figure 6:
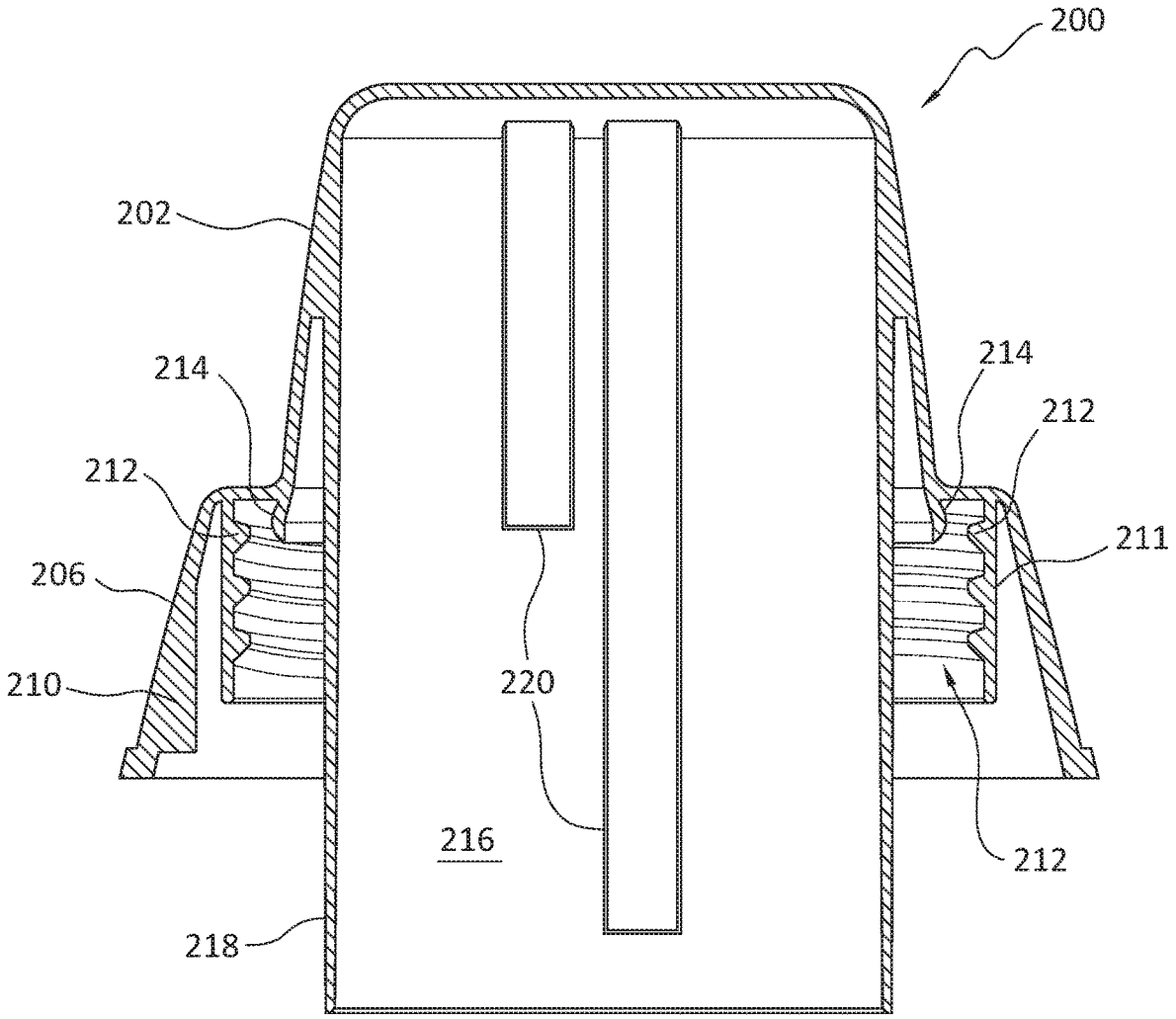
FIG. 6 is a section view of an example closure.
Figure 7:
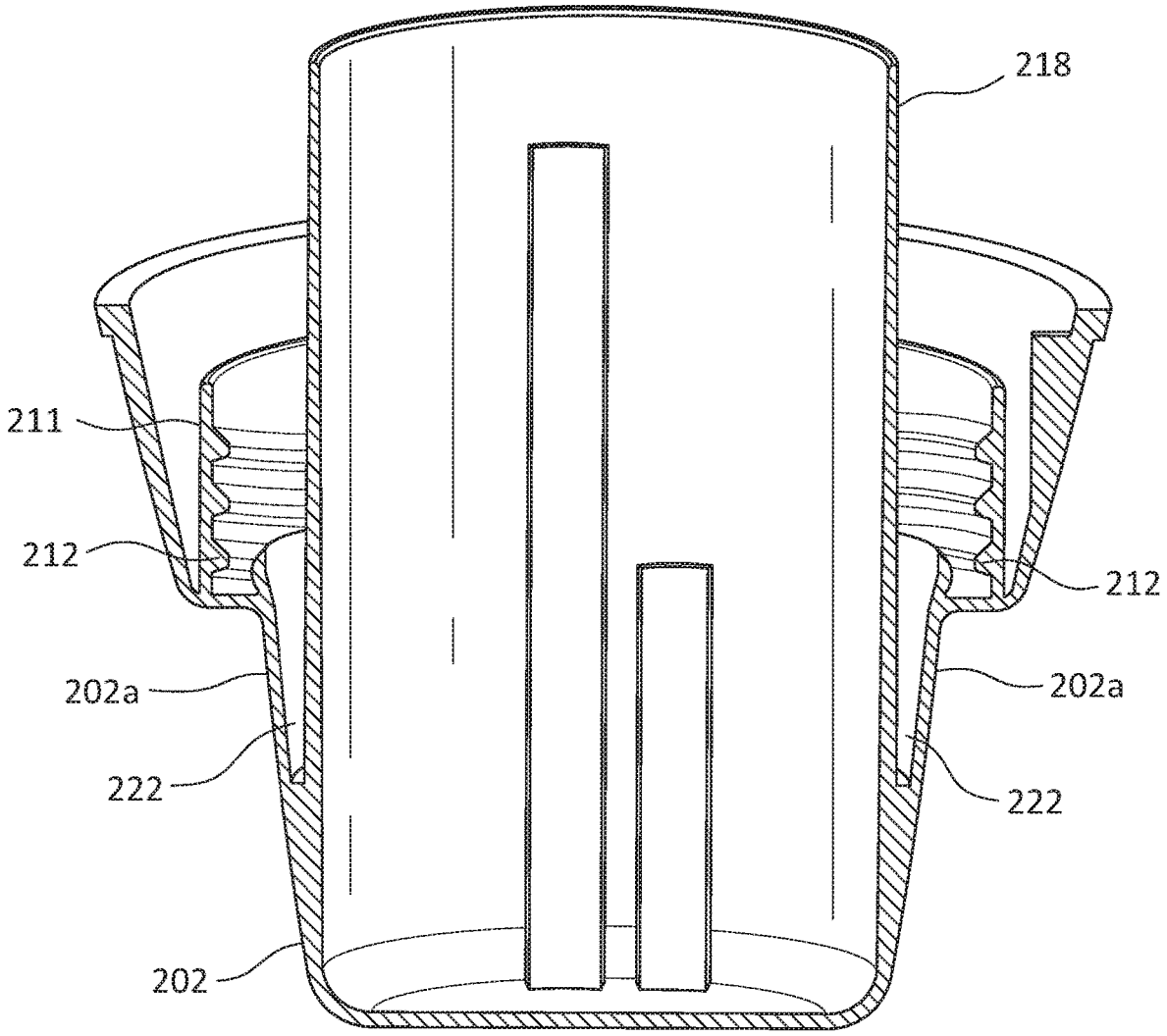
FIG. 7 is a section view of an example closure.

With particular reference now to FIGS. 5-7, the lower portion 206 includes, on its interior wall 206*a*, one or more inwardly extending flanges 210. As indicated, the flanges 210 may reside entirely within the closure 200 and, particularly, entirely within the lower portion 206. As such, the flanges 210 may not be visible when the closure 200 is locked to the bottle 100, particularly when the closure 200 is opaque.

In some embodiments, and shown in FIG. 5 in particular, the flanges 210 may each be disposed about 90 degrees away from one or more sets of grip elements 208. In one particular embodiment, one or more flanges 210 are disposed between about 40 degrees and about 50 degrees away from the grip elements 208. In another particular embodiment, one or more flanges are disposed about 45 degrees away from the grip elements 208. In some embodiments, one or more flanges may be positioned, relative to the grip elements 208, such that maximum deflection of the flange 210 may be achieved when the grip elements 208 are squeezed. In some particular embodiments, the flange 210 location corresponding to maximum deflection may be between about 35 degrees to about 55 degrees from the grip elements 208. However, the flange 210 location corresponding to maximum deflection may be different in other embodiments and, as such, the range of about 35 degrees to about 55 degrees is provided only by way of example. For example, flange 210 locations may be greater, or less than, about 35 degrees to about 55 degrees away from the grip elements 208.

Thus, in still other embodiments, the flanges 210 may be disposed less than 90 degrees, or more than 90 degrees, away from one or more of the sets of grip elements 208. For example, one or more of the flanges 210 may be positioned, relative to a set of grip elements 208, anywhere in a range of about 5 degrees to about 85 degrees away from that set of grip elements. Additionally, or alternatively, one or more of the flanges 210 may be positioned, relative to a set of grip elements 208, anywhere in a range of about 95 degrees to about 175 degrees away from that set of grip elements. The distance between a flange 210 and a set of grip elements 208 may be measured, for example, from the center of the set of grip elements 208 to the flange 210, or from the one of the outermost grip elements 208, in a group of grip elements 208, to the flange 210.

When the closure 200 is locked onto the bottle 100, each of the flanges 210 abuts, or resides near, a corresponding upstanding wall 114 of the bottle 100. More particularly, a portion of the flange 210, such as a face of the flange 210 for example, may contact, or reside near, the face of the upstanding wall 114. Where a flange is angled (see, e.g., FIGS. 19 and 20), a leading edge, or trailing edge, of the flange may contact, or reside near, the face of the upstanding wall 114. In this way, movement of the flange 210 and, thus, movement of the closure 200, is prevented until the flange 210 is deflected to an extent that the upstanding wall 114 no longer interferes with movement of the flange 210, as can may be effected by rotation of the closure 200.

Thus, one consequence of the aforementioned arrangement of the flanges 210 and grip elements 208 is that as the user squeezes the grip elements 208 with adequate effort, the closure 200 is elastically deformed in such a way that the flanges 210 move outwardly, that is, in an x-direction (see reference axes in FIG. 1). More particularly, the lower portion 206 of the closure may be temporarily elastically deformed from its normal circular shape to a non-circular shape, thereby temporarily modifying the position and orientation of the flanges 210, generally in the x-direction, relative to the corresponding lugs 110.

Figure 10:
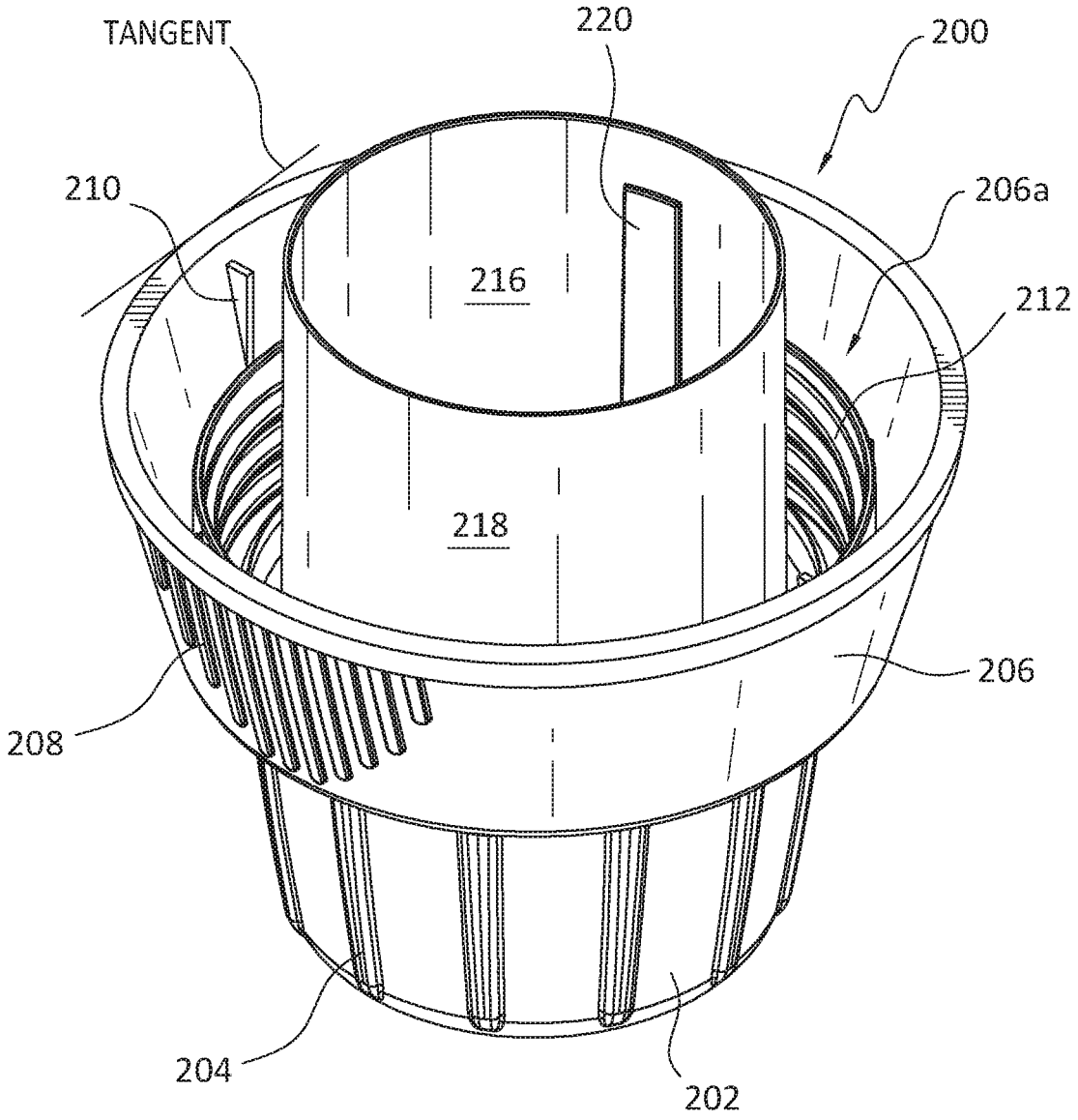
FIG. 10 is a bottom perspective view of an example closure
Figure 11:
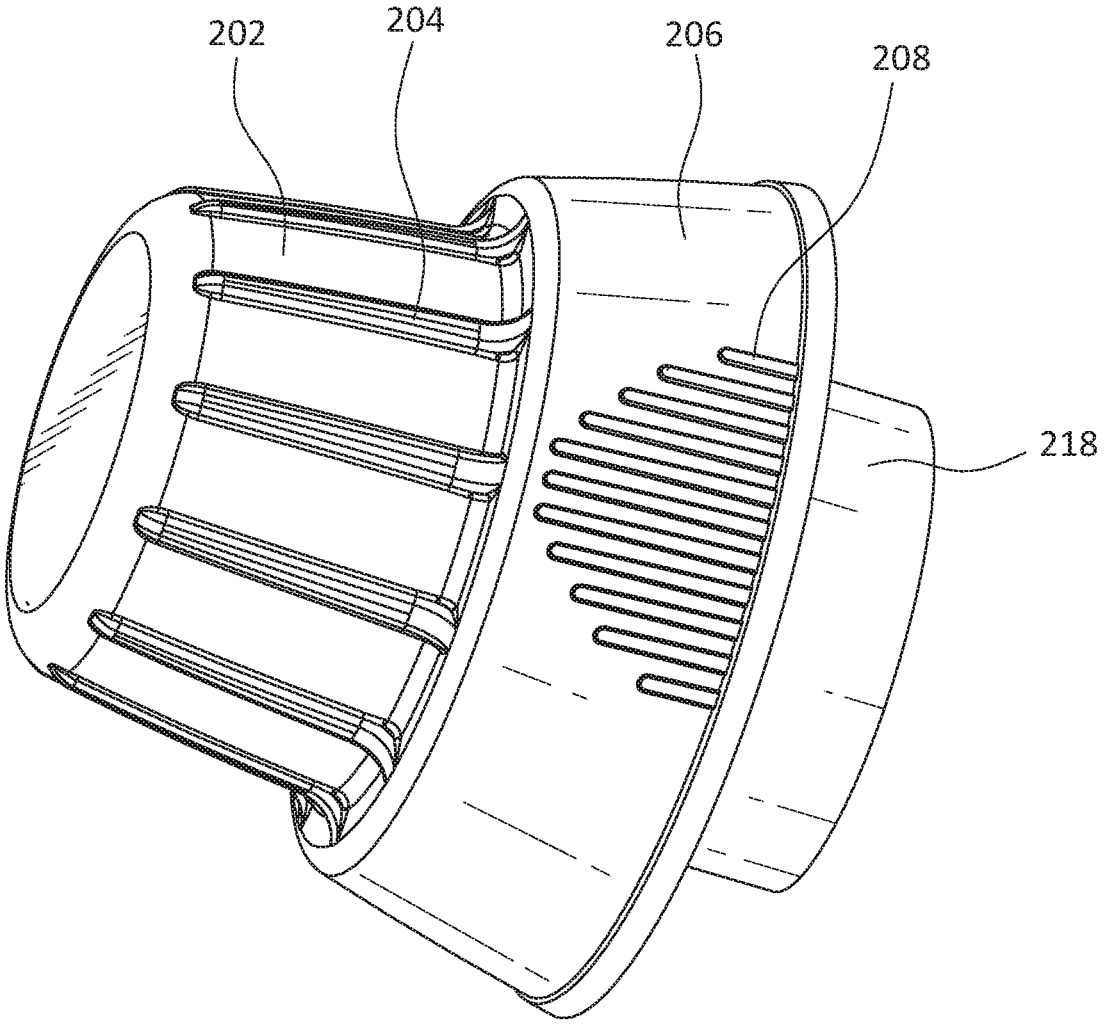
FIG. 11 is a side perspective view of an example closure.
Figure 12:
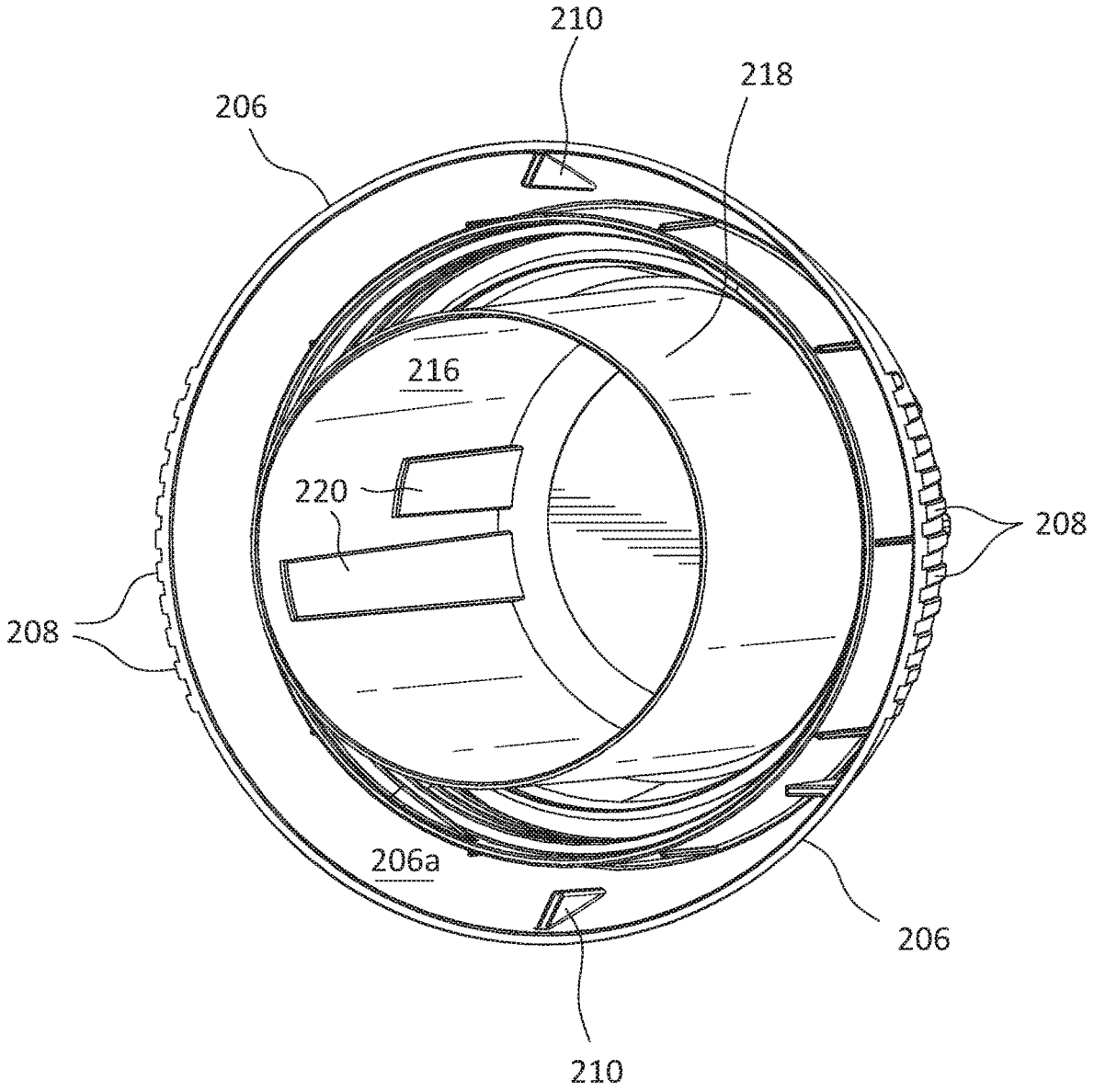
FIG. 12 is a bottom perspective view of an example closure.
Figure 13:
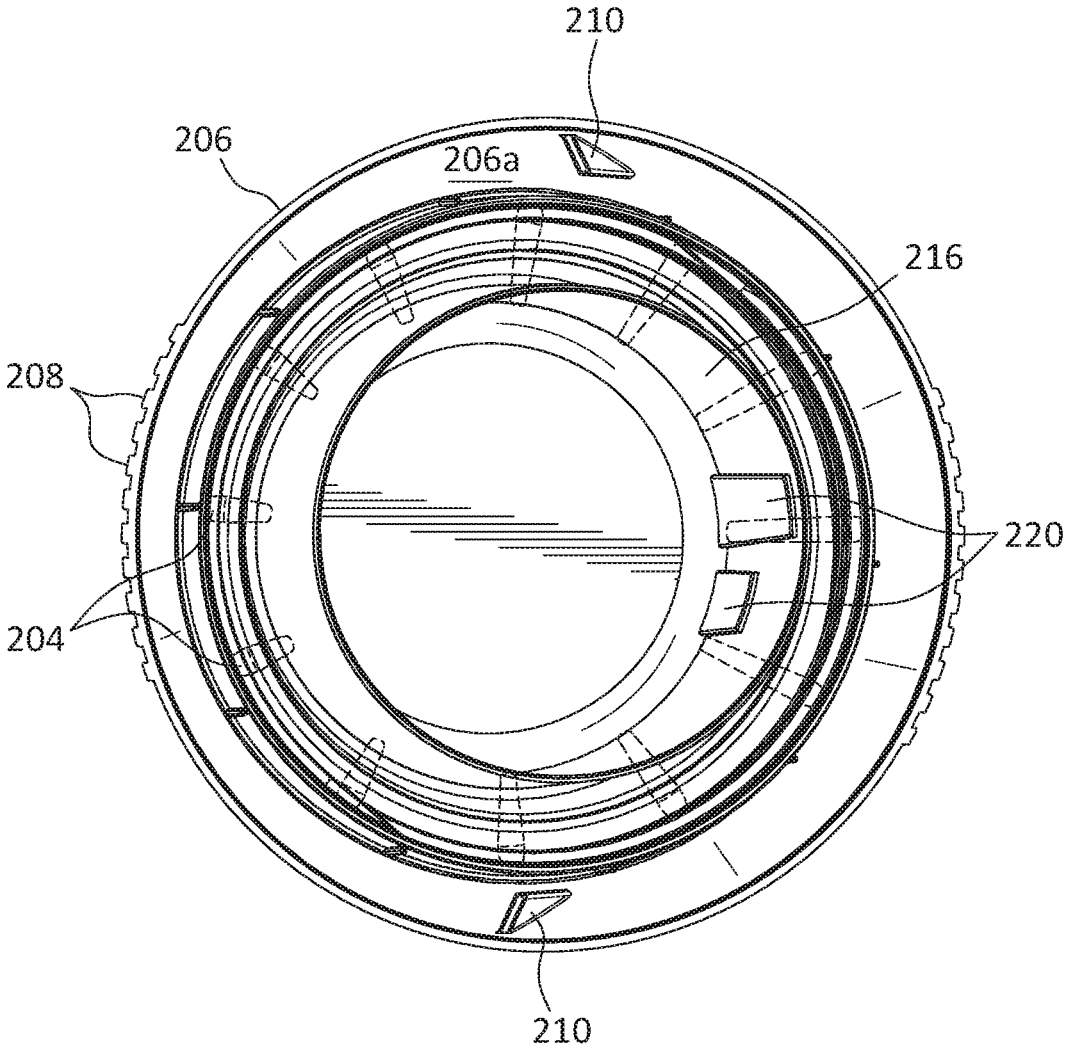
FIG. 13 is a partial bottom perspective view of an example closure.
Figure 14:
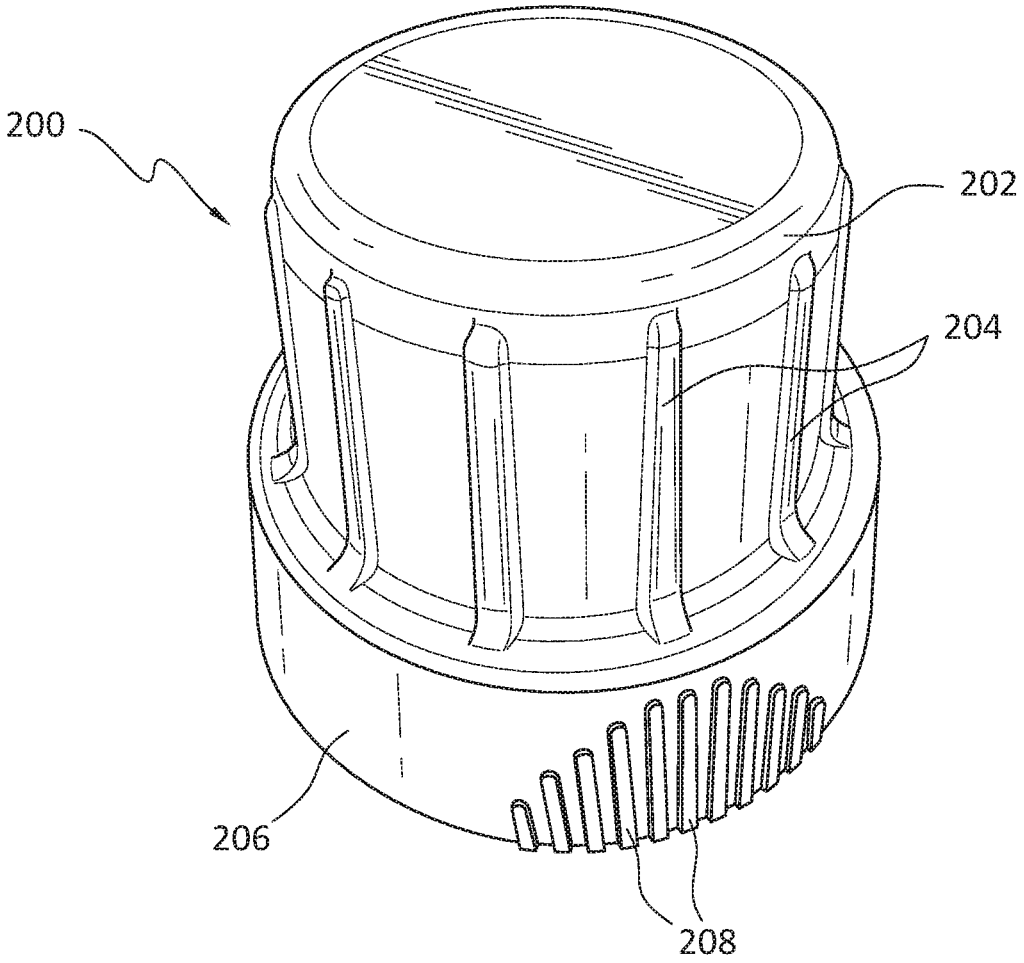
FIG. 14 is a top perspective view of an example closure.
Figure 15:
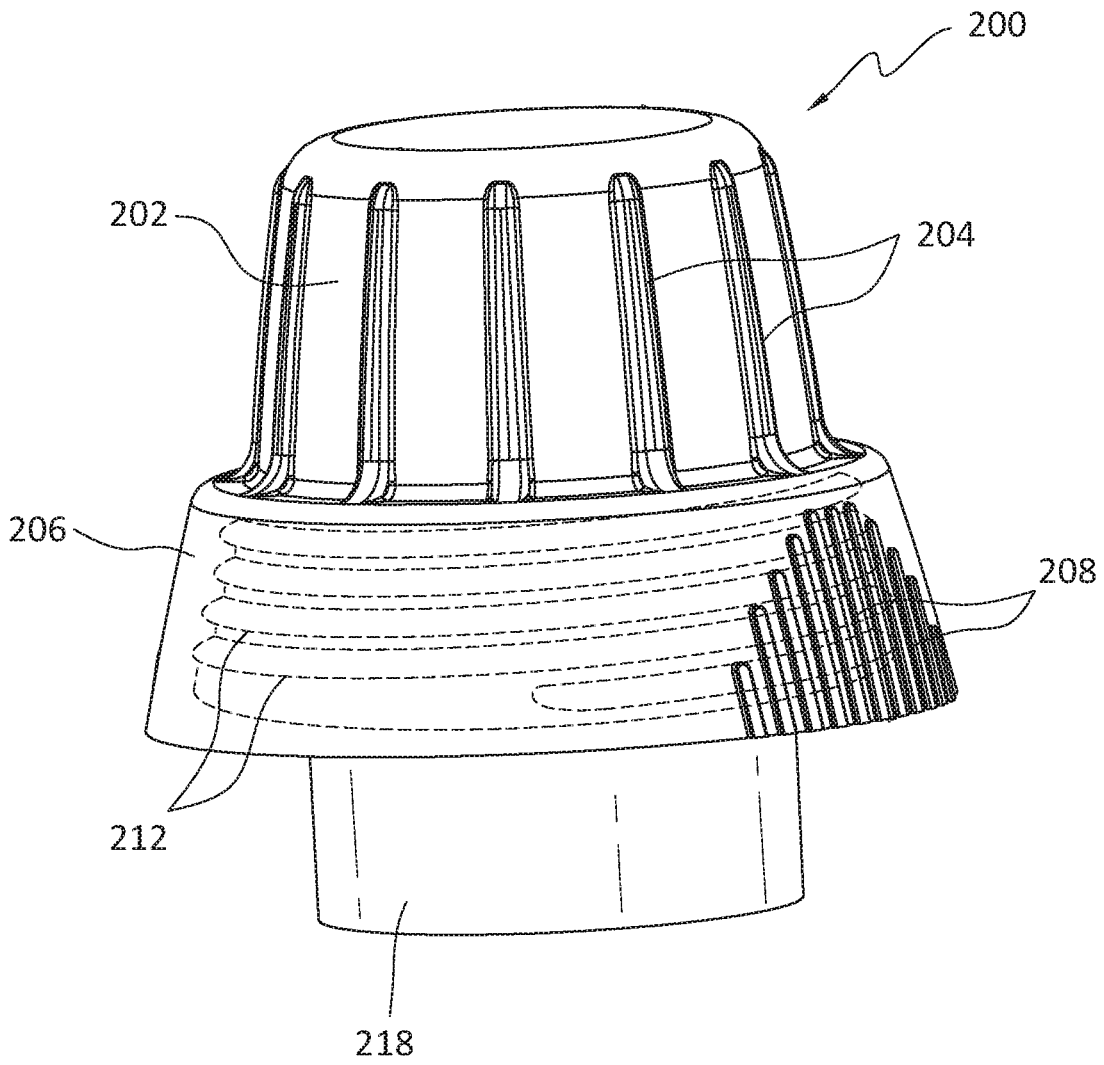
FIG. 15 is a side view of an example closure.
Figure 16:
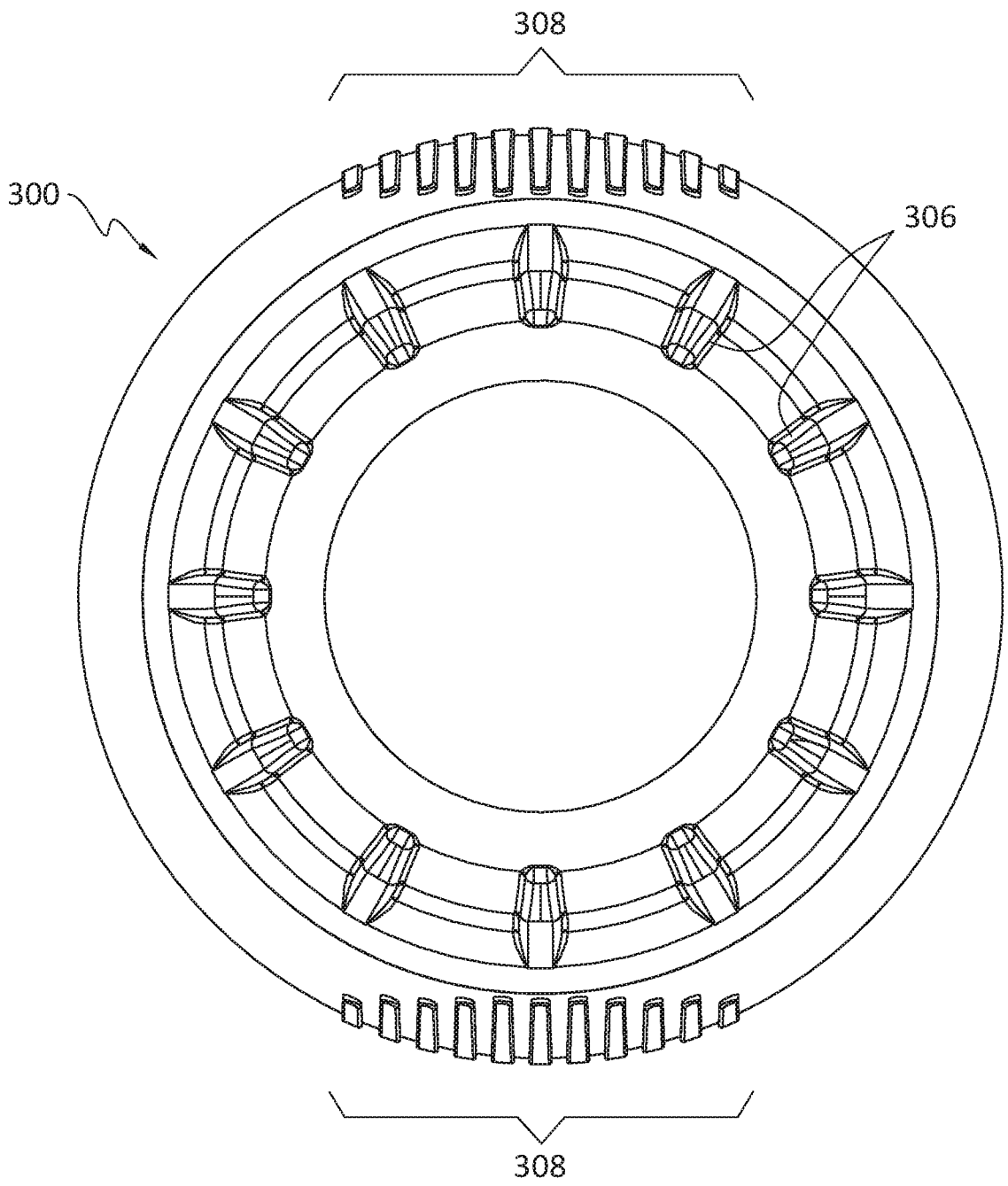
FIGS. 16-20 disclose aspects of an alternative embodiment of a closure.
Figure 17:
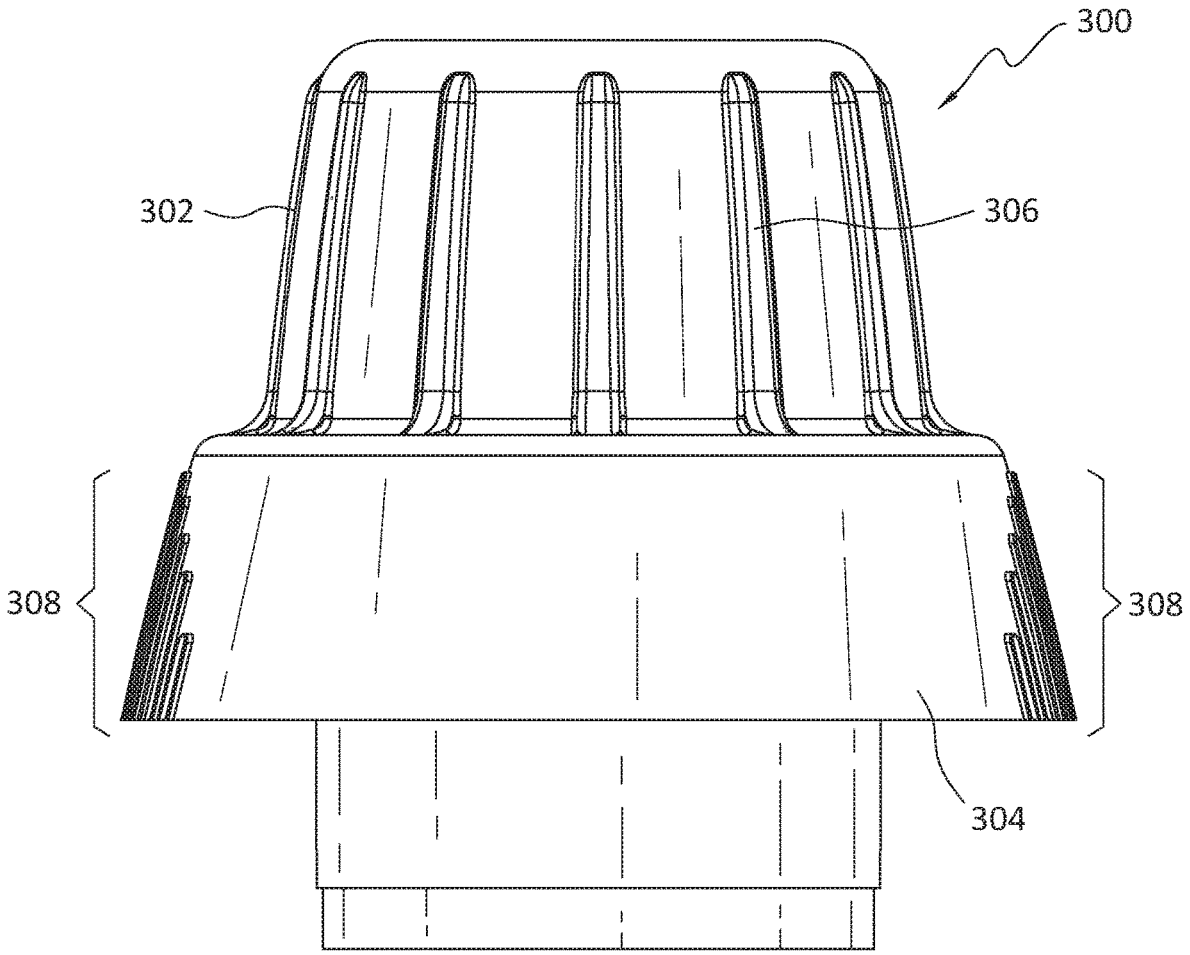
Figure 18:
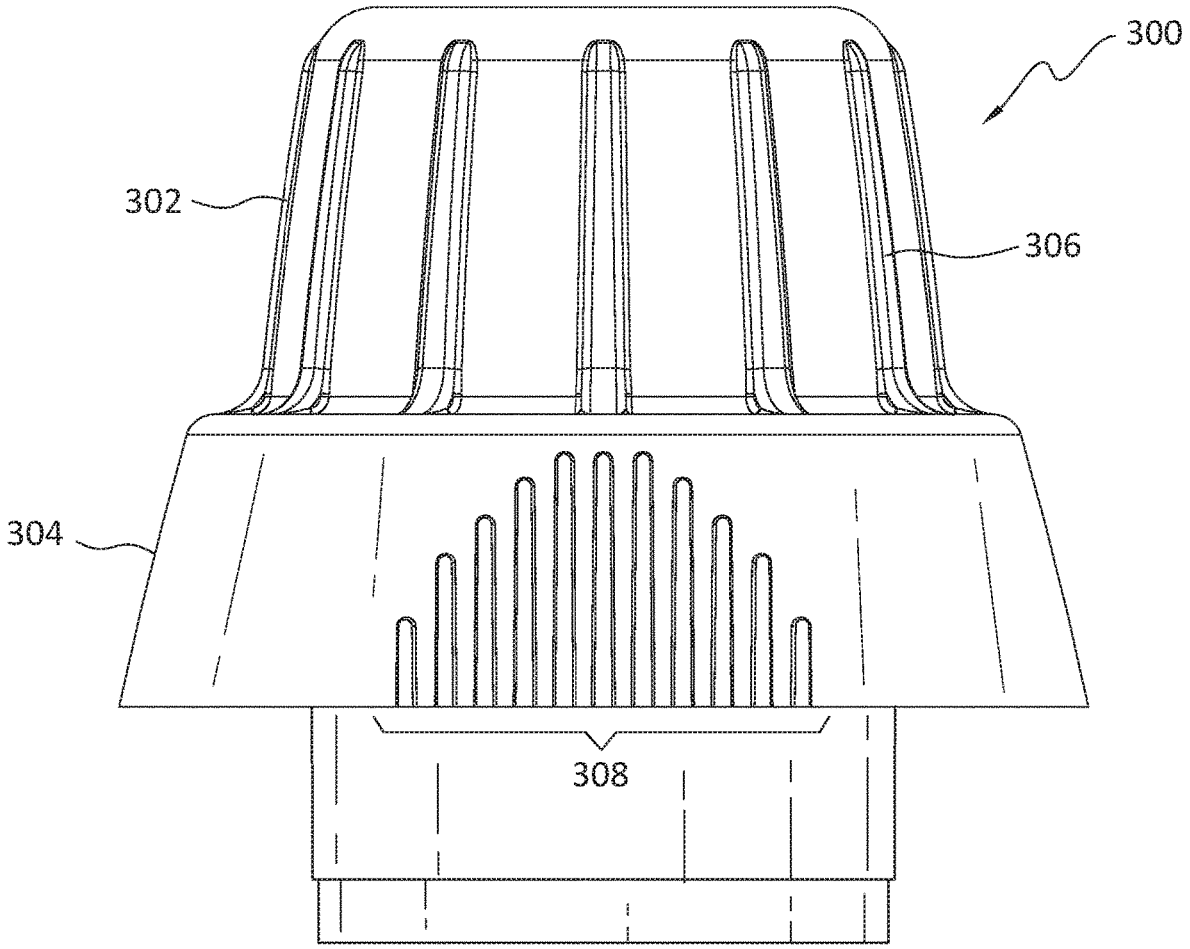

With particular reference to FIG. 10, it can be seen that the flange 210 may be oriented to be generally perpendicular relative to a line drawn tangent to the lower portion 206 of the closure 200 at the location where the flange 210 attaches to the interior of the lower portion 206. This particular orientation of the flange 210 is not required however, as discussed below in connection with FIGS. 16-20, and other orientations of the flange 210, such as about 45 degrees relative to the aforementioned tangent line for example, may be implemented. More generally, in any disclosed embodiment, flange orientations may be implemented that fall anywhere in a range of about 35 degrees to about 125 degrees relative to an imaginary tangent line touching the lower portion at a location where the flange is attached to the lower portion.

Directing attention now to FIGS. 6-7 in particular, further details are provided concerning the example closure 200. In particular, the interior of the closure 200 may include an annular sleeve 211 having an interior set of threads 212 that are generally configured and arranged to interface with the threads 108 of the bottle 100. It will be apparent that the threads 212 may be similar, or identical, to the threads 108. As also indicated in FIGS. 6 and 7, the closure 200 may include an annular lip 214 that is biased towards the uppermost thread 212. As the closure 200 is rotated into engagement with the threads 108 of the bottle 100, the bias of the annular lip 214 is overcome and the threads 108 engage the upper most thread 212 of the closure. Because the annular lip 214 tends to push the threads 108 and 212 together, a fluid-tight seal between the bottle 100 and closure 200 is formed when the closure 200 is locked onto the bottle 100. In some embodiments, a separate sealing element may additionally be provided to provide a fluid-tight seal of the closure 200 to the bottle 100.

With continued reference to FIGS. 5-13, the example closure 200 includes a reservoir 216 collectively defined by a reservoir wall 218 and the upper portion 202. The reservoir 216 defines a volume within which a volume of material, such as liquid detergent for example, may be dispensed from the bottle 100. The interior of the reservoir wall 218 may include indicators 220 extending inwardly from the interior of the reservoir wall 218 and indicating different volumes of fluid, powder, or other material, that may be needed for different amounts/types of laundry, for example. Depending upon the need, fluid, powder or other materials may be poured into the reservoir 218 to the top of one of the indicators 220. The indicators 220 may alternatively take the form of a surface treatment, such as texturing, on the interior of the reservoir wall 218. In some embodiments, the indicators 220 are omitted.

With particular reference to FIG. 7, the closure 200 may be configured to provide an overflow reservoir 222 to catch fluid, such as laundry detergent, that overtops the reservoir wall 218. As shown, the overflow reservoir 222 is annular in its configuration and is cooperatively defined by the reservoir wall 218 and an outer wall 202*a* of the upper portion 202. Because the overflow reservoir 222 is positioned between the reservoir wall 218 and the outer wall 202*a*, any fluid overtopping the reservoir wall 218, or otherwise coming into contact with the reservoir wall 218, will flow down into the overflow reservoir 222 without contacting the threads 212. Thus, when the closure 200 is turned right side up (see FIG. 6), any fluid in the overflow reservoir 222 will flow down the sides of the reservoir wall 218 without contacting the threads 212. Because the threads 212 remain clean, there is no danger of fluid coming into contact with the threads 108 of the bottle 100, and then running down the sides of the bottle 100, when the threads 212 engage the threads 108. As noted elsewhere herein, some embodiments of a closure may omit the overflow reservoir.

C. Operation of an Example Closure and Bottle

With continued reference to the Figures, when the closure 200 is placed on the bottle 100 and rotated clockwise, the threads 108 and 212 engage each other and the closure 200 moves into a closed position or state. As the closure 200 rotates toward the closed position, the flanges 210 each move up a face 112*a* of a ramp 112, eventually coming to rest at a position abutting, or near, a respective upstanding wall 114. This operation may involve some elastic deformation, that is, deflection or bending, of the flanges 210 until the flanges 210 come to a position at which the closure 200 is releasably locked to the bottle 100. In more detail, when the closure 200 is locked onto the bottle 100, the flanges 210 are in an undeformed state and are positioned such that the upstanding walls 114 of the lugs 110 interfere with the flanges 210, that is, the lugs 110 prevent counterclockwise motion of the closure 200 by blocking the flanges 210 from moving.

To unlock the closure 200 from the bottle 100, the user can grasp the closure 200, such as at the grip elements 208, and squeeze the closure 200 to elastically deform the lower portion 206, and thereby move and/or elastically deform the flanges 210 so that the lugs 110 no longer present an interference to the flanges 210. Once the flanges 210 have assumed this location and/or state, the closure 200 can then be rotated counterclockwise and removed from the bottle 100.

D. Further Aspects of Some Example Embodiments

With continued attention to the Figures, following is a discussion of further aspects of example embodiments. It should be understood that none of such aspects are necessarily required to be present in any particular embodiment, and are presented only by way of example.

As best shown in FIGS. 2 and 3, the lug 110 may have a ramp portion 112 with a compound configuration. That is, the outside edge 112*b*-1 of the ramp face 112*e* may be offset, in a clockwise sense, from the inside edge 112*b*-2 of the ramp face 112*e*. Put another way, the outside edge 112*b*-1 is axially unaligned with the inside edge 112*b*-2, such that the beginning and end of the outside edge 112*b*-1 are positioned ahead, in a clockwise sense, of the beginning and end, respectively, of the inside edge 112*b*-2.

With further reference to FIGS. 2 and 3, the aforementioned offset, combined with leading edge of the lug 110 that is defined by the upstanding wall 114, results in a generally triangular shape of the upper surface 112*d*, although other shapes of the upper surface 112*d* may be employed, and a triangular shape is not required. The upper surface 112*d*, which may be generally parallel to the surface of the shoulder 104, may have various other shapes as well however. In some instances, the shape and orientation of the upper surface 112*d* may be necessitated by the offset of the outside edge 112*b*-1 and inside edge 112*b*-2 with respect to each other. It will be appreciated that the example lug 110 geometry is relatively more complex than, and thus not intuitive in view of, some of the simple geometries known in the art. Moreover, the lug 110 geometry may enable, or even require, the use of particular flange 210 geometries.

For example, and with reference to FIG. 5 in particular, it can be seen that the flange 210 may, but is not required to, have a generally triangular shape, in which the widest portion of the flange 210 is positioned lower in the closure 200, given the orientation of the closure 200 in FIG. 5, than the narrowest part of the flange 210. In the illustrated example, the innermost edge of the flange 210 may be generally vertical with respect to a y-direction, while the edge of the flange 210 at the interior wall 206*a* is disposed at an angle with respect to the y-direction that generally matches an angle of inclination of the interior wall 206*a*. A triangular, or wedge shaped, configuration of the flange 210 may help to ensure that the flange 210 is able to clear the lug 110 when the flange 210 is rotated radially away from the lug 110 as the user squeezes the closure 200. It is noted that the flange 210 is not required to have a triangular shape, and any other flange 210 shape that may provide the disclosed functionality may alternatively be employed. For example, a flange such as the flange 210 may have a generally rectangular shape.

In at least some embodiments, the closure 200 and/or bottle 100 do not require any type of frangible element(s) connecting them. As such, disclosed embodiments may be advantageous with respect to known closures that require the use of one or more frangible elements.

In at least some embodiments, one example of which is disclosed in FIG. 6, the overflow reservoir 222 has an annular configuration and, as such, extends around the entire circumference of the reservoir wall 218. Advantageously, such a configuration of the overflow reservoir 222 may help to ensure that any overflowing material from the reservoir 216 is captured by the overflow reservoir 222, regardless of the particular location(s) of the reservoir wall 218 where the overflow occurs.

As noted in the example embodiment of FIG. 7, a depth of the overflow reservoir 222 may be such that the overflow reservoir 222 does not extend all the way to, or through, the bottom of the upper portion 202. That is, the floor, or bottom, of the overflow reservoir 222 may not be defined by the bottom of the upper portion 202. For example, the overflow reservoir 222 may not extend through the bottom (as viewed from the perspective of FIG. 7) of the upper portion 202 and, instead, the overflow reservoir 222 may have a floor and thus may be able to capture and retain fluid such that the captured fluid does not drain out of the overflow reservoir 222 when the closure is oriented as shown in FIG. 7. In other embodiments, the overflow reservoir 222 may extend to, or near, the bottom of the upper portion 202. In at least some embodiments, the overflow reservoir 222 and the reservoir wall 218 are integral with each other and with the other elements of the closure 200 such that the closure 200 is implemented as a single piece of material.

Some example embodiments of the closure 200 and bottle 100 also collectively provide for a spout-less configuration. Rather, as shown in FIGS. 1-5, for example, some embodiments simply provide for a bottle 100 that has a neck 106 that defines a mouth 107, and a closure 200 that includes a reservoir 216, such as in the form of a dosing cup. Advantageously, the spout-less configuration eliminates the need to provide a separate, or integrated, spout element as part of the apparatus.

Finally, some example embodiments of an apparatus consist only of the closure 200 and bottle 100. In contrast with some known configurations, there is no use or need, in such example embodiments, for an intervening element, such as a spout or other structure for example, part or all of which is positioned between the closure 200 and the bottle 100 when the closure 200 is connected to the bottle 100. Yet other example embodiments, while they may comprise a closure 200 and/or bottle 100, do not include intervening elements such as the example spout just noted. Advantageously, embodiments that do not employ or include an intervening element may be relatively simpler to operate, and less expensive to produce, than known configurations that employ one or more intervening elements.

E. Aspects of an Example Alternative Embodiment

With attention finally to FIGS. 16-20, details are provided concerning an alternative embodiment of a closure, which is designated generally at 300. Except as may be noted herein, the closure 300 may be similar, or identical, to the closure 200. Moreover, any aspect or feature of the embodiments of FIGS. 16-20 may be implemented in any of the embodiments of FIGS. 1-15, and vice versa. As such, the following discussion is generally directed to selected differences between the closure 300 and the closure 200. Notably, the closure 300 does not include an overflow reservoir.

As shown, the closure 300 may comprise an upper portion 302 and lower portion 304. The upper portion 302 may include one or more upper grip elements 306, which may be arranged in one or more groups, or may be distributed uniformly about the circumference of the upper portion 302. As well, the lower portion 304 may include one or more lower grip elements 308, which may be arranged in one or more groups, or may be distributed uniformly about the circumference of the lower portion 304. In one or more embodiments, the lower grip elements 308 may form two groups that are disposed about 180 degrees apart from each other. In other embodiments, more, or fewer, groups of lower grip elements 308 may be employed, and the groupings of lower grip elements 308 may be provided that are disposed at different positions relative to each other. For example, three groups of lower grip elements 308 may be provided that are disposed about 120 degrees apart from each other. The scope of the invention is not limited to any particular number or arrangement of lower grip elements 308, or upper grip elements 306.

In one embodiment, the outside diameter at, or near, the top of the upper portion 302 may be about 38.49 mm without taking into account the upper grip elements 306. When the upper grip elements 306 are taken into consideration, the outside diameter at, or near, the top of the upper portion 302 may be about 39.96 mm. These dimensions are provided only by way of example, and are not intended to limit the scope of the invention. Larger, and smaller, outside diameters of the top of the upper portion 302 may be employed in other embodiments.

Figure 19:
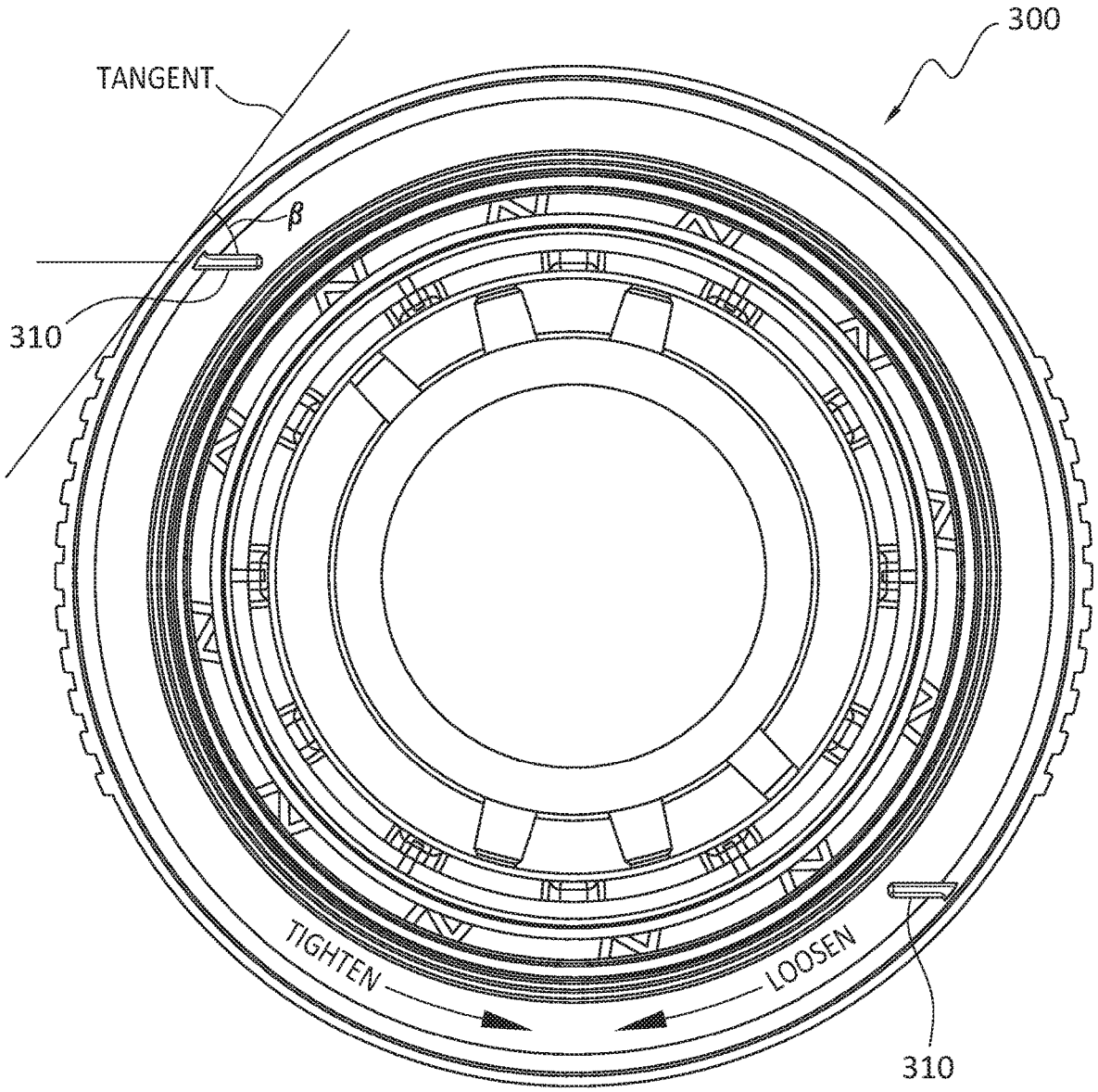
Figure 20:
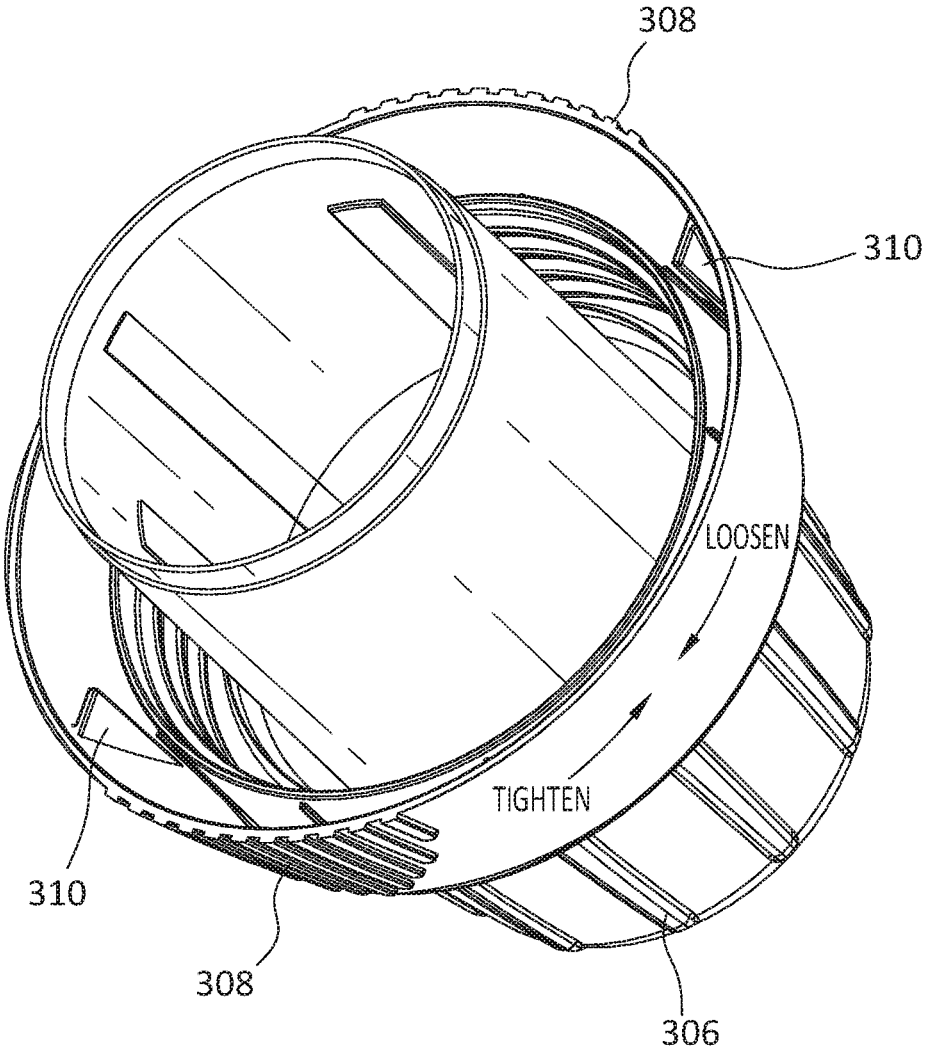

With particular reference to FIGS. 19 and 20, one or more flanges 310 may be provided that are configured to interface with corresponding structures of a bottle, such as the bottle 100 discussed above in connection with the closure 200. The principles of the interaction of the flanges 310 with the bottle 100 may be the same as described in the discussion of the closure 200, although one or more of the flanges 310 may have an orientation and/or configuration that is different from the orientation and/or configuration of the flanges 210.

As best shown in FIG. 20, one or more of the flanges 310 may have a generally triangular shape, although no particular shape or configuration of the flanges 310 is required. A well, and shown in FIG. 19, one or more of the flanges 310 may be oriented to be non-perpendicular relative to a line drawn tangent to the lower portion 306 at the location where the flange 310 attaches to the interior of the lower portion 306. For example, in one embodiment, one or more of the flanges 310 may be disposed at an angle β of about 45 degrees relative to a line drawn tangent to the lower portion 306 at the location where the flange 310 attaches to the interior of the lower portion 306. Such non-perpendicular orientations of one or more of the flanges 310 may help to strengthen the flange 310 so that the flange 310 is less likely to smear, or break, during use. Angles β of other than 45 degrees may be employed. For example, any angle β between about 0 degrees and about 90 degrees, relative to the tangent line, may be used for the orientation of a flange 310.

Thus, a flange 310 may be located and oriented in such a way that the flange 310, in cooperation with a lug 110 and/or other structure of a bottle such as the bottle 100, tends to resist removal of the closure 300 from a bottle 100, but the flange 310 provides no material impediment to attachment of the closure 300 to a bottle 100, as shown by the 'tighten' and 'loosen' notation in FIGS. 19 and 20. That is, it can be seen from those Figures that the flanges 310 may, as a consequence of their location and/or orientation, be able to move readily past corresponding structure of a bottle 100 when the closure 300 is being tightened on the bottle 100, but the flanges 310 may likewise tend to resist, or completely prevent, loosening of the closure 300 relative to the corresponding structure of the bottle 100 unless, or until, the user squeezes the lower grip elements 308 so as to elastically reposition the flanges 310 relative to the corresponding structure of the bottle 100.

As further indicated in FIGS. 19 and 20, one or more of the flanges 310 may be located relatively near to a respective group of lower grip elements 308, although that is not necessarily required. As a result, when the user squeezes the lower grip elements 308, that squeezing motion may act to elastically reposition the nearby flanges 310 so that the closure 300 can be removed. This configuration and arrangement of the flanges 310 relative to corresponding structure of a bottle 100 may be referred to as a ratchet and/or as implementing a ratchet effect since, absent any efficacious squeezing of the lower grip elements 308 by a user, the closure 300 can only be tightened on the bottle 100, but not loosened.

F. Further Example Embodiments

Following are some further example embodiments of the invention. These are presented only by way of example and are not intended to limit the scope of the invention in any way.

Embodiment 1. A closure, comprising: an upper portion; a lower portion attached to the upper portion and including a flange extending inwardly from an interior wall of the lower portion, and the flange resides entirely within the lower portion; a plurality of grip elements located on an outer surface of the lower portion; and an annular sleeve disposed in the lower portion and including a set of interior threads.

Embodiment 2. The closure as recited in embodiment 1, wherein the closure comprises a reservoir defined in part by a reservoir wall and extending from the upper portion through the lower portion, and wherein the reservoir wall and an inner wall of the upper portion cooperate to define an annular overflow reservoir configured to capture and retain overflow from the reservoir.

Embodiment 3. The closure as recited in embodiment 2, wherein the overflow reservoir is radially positioned between the threads and the reservoir wall.

Embodiment 4. The closure as recited in any of embodiments 1-3, further comprising an annular lip disposed within the annular sleeve and biased towards the interior threads.

Embodiment 5. The closure as recited in any of embodiments 1-4, wherein in a first operational state, the flange is in a first position, and in a second operational state, the flange is in a second position that is different from the first position.

Embodiment 6. The closure as recited in any of embodiments 1-5, wherein in a first operational state, the flange is in a deformed and/or deflected state, and in a second operational state, the flange is in an undeformed and/or undeflected state.

Embodiment 7. The closure as recited in any of embodiments 1-6, wherein the flange is located anywhere in a range of about 35 degrees to about 55 degrees apart from the plurality of grip elements.

Embodiment 8. A bottle, comprising: one or more walls and a bottom connected with the walls, the bottom and the walls defining a volume; a neck connected with the one or more walls and including a set of exterior threads; a shoulder connecting the one or more walls to the neck; and a lug disposed on the shoulder and including a ramp portion and an upstanding wall, and the ramp portion has a compound configuration in which an inside edge of the ramp portion is offset, in a clockwise respect, from an outside edge of the ramp portion.

Embodiment 9. The bottle as recited in embodiment 8, wherein the upstanding wall is about perpendicular to the shoulder.

Embodiment 10. The bottle as recited in any of embodiments 8-9, wherein the ramp portion is configured so that a high end of the ramp portion is located a distance clockwise from a low end of the ramp.

Embodiment 11. The bottle as recited in any of embodiments 8-10, wherein the lug includes an upper surface that is about parallel to the shoulder.

Embodiment 12. The bottle as recited in any of embodiments 8-11, wherein the lug includes an outside upstanding wall that is about perpendicular to the shoulder and abuts the upstanding wall.

Embodiment 13. The bottle as recited in any of embodiments 8-12, further comprising a second lug disposed about 90 degrees apart from the lug.

Embodiment 14. The bottle as recited in any of embodiments 8-13, wherein the lug includes an upper surface that is about parallel to the shoulder.

Embodiment 15. An apparatus, comprising: a bottle, comprising: one or more walls and a bottom connected with the walls, the bottom and the walls defining a volume; a neck connected with the one or more walls and including a set of exterior threads; a shoulder connecting the one or more walls to the neck; and a lug disposed on the shoulder and including a ramp portion and an upstanding wall, and the ramp portion has a compound configuration in which an inside edge of the ramp portion is offset, in a clockwise respect, from an outside edge of the ramp portion; and, a closure that is releasably connectible to the bottle, the closure comprising: a lower portion including a flange extending inwardly from an interior wall of the lower portion, and the flange resides entirely within the lower portion; and an annular sleeve disposed in the lower portion and including a set of interior threads.

Embodiment 16. The apparatus as recited in embodiment 15, wherein the lower portion comprises a plurality of grip elements located on an outer surface of the lower portion.

Embodiment 17. The apparatus as recited in any of embodiments 15-16, wherein the closure comprises an upper portion connected to the lower portion, and the upper portion comprises a plurality of grip elements.

Embodiment 18. The apparatus as recited in any of embodiments 15-17, further comprising a reservoir defined in part by a reservoir wall and extending from the upper portion through the lower portion, wherein the reservoir wall and an inner wall of the upper portion cooperate to define an annular overflow reservoir configured to capture and retain overflow from the reservoir.

Embodiment 19. The apparatus as recited in embodiment 18, wherein the overflow reservoir is radially positioned between the threads of the closure and the reservoir wall.

Embodiment 20. The apparatus as recited in any of embodiments 15-19, wherein the flange is disposed at an angle in a range of about 35 degrees to about 125 degrees relative to an imaginary tangent line touching the lower portion at a location where the flange is attached to the lower portion.

The present invention may be embodied in other specific forms without departing from its spirit or essential characteristics. The described embodiments are to be considered in all respects only as illustrative and not restrictive. All changes which come within the meaning and range of equivalency of the claims are to be embraced within their scope.

What is claimed:

1. An apparatus, comprising:

a bottle, comprising:

one or more walls and a bottom connected with the walls, the bottom and the walls defining a volume;

a neck connected with the one or more walls and including a set of exterior threads;

a shoulder connecting the one or more walls to the neck; and a lug disposed on the shoulder and including a ramp portion and an upstanding wall, and the ramp portion has a compound configuration in which an inside edge of the ramp portion is axially unaligned with an outside edge of the ramp portion; and, a closure that is releasably connectible to the bottle, the closure comprising:

a lower portion including a flange extending inwardly from an interior wall of the lower portion, and the flange resides entirely within the lower portion; and an annular sleeve disposed in the lower portion and including a set of interior threads.

2. The apparatus as recited in claim 1, further comprising an annular lip disposed within the annular sleeve and biased towards the set of interior threads.

3. The apparatus as recited in claim 1, wherein in a first operational state, the flange is in a first position, and in a second operational state, the flange is in a second position that is different from the first position.

4. The apparatus as recited in claim 1, wherein in a first operational state, the flange is in a deformed and/or deflected state, and in a second operational state, the flange is in an undeformed and/or undeflected state.

5. The apparatus as recited in claim 1, wherein the lower portion comprises a plurality of grip elements located on an outer surface of the lower portion.

6. The apparatus as recited in claim 1, wherein the upstanding wall is about perpendicular to the shoulder.

7. The apparatus as recited in claim 1, wherein the ramp portion is configured so that a high end of the ramp portion is located a distance clockwise from a low end of the ramp portion.

8. The apparatus as recited in claim 1, wherein the lug includes an upper surface that is about parallel to the shoulder.

9. The apparatus as recited in claim 1, wherein the lug includes an outside upstanding wall that is about perpendicular to the shoulder and abuts the upstanding wall.

10. The apparatus as recited in claim 1, further comprising a second lug disposed about 90 degrees apart from the lug.

11. The apparatus as recited in claim 5, wherein the lug includes an upper surface that is about parallel to the shoulder.

12. The apparatus as recited in claim 5, wherein the flange is located anywhere in a range of about 35 degrees to about 55 degrees apart from the plurality of grip elements.

13. The apparatus as recited in claim 1, wherein the closure comprises an upper portion connected to the lower portion, and the upper portion comprises a plurality of grip elements.

14. The apparatus as recited in claim 13, further comprising a reservoir defined in part by a reservoir wall and extending from the upper portion through the lower portion, wherein the reservoir wall and an inner wall of the upper portion cooperate to define an annular overflow reservoir configured to capture and retain overflow from the reservoir.

15. The apparatus as recited in claim 14, wherein the overflow reservoir is radially positioned between the set of interior threads of the closure and the reservoir wall.

16. The apparatus as recited in claim 1, wherein the flange is disposed at an angle in a range of about 35 degrees to about 125 degrees relative to an imaginary tangent line touching the lower portion at a location where the flange is attached to the lower portion.

* * * * *